US007010255B2

(12) United States Patent
Yura et al.

(10) Patent No.: US 7,010,255 B2
(45) Date of Patent: Mar. 7, 2006

(54) FIXING DEVICE HAVING A HEATING MEMBER AND IMAGE FORMING APPARATUS INCLUDING THE SAME

(75) Inventors: Jun Yura, Kanagawa (JP); Hirokazu Ikenoue, Tokyo (JP); Katsuhiro Echigo, Saitama (JP); Takashi Fujita, Tokyo (JP); Hisashi Kikuchi, Kanagawa (JP); Atsushi Nakafuji, Tokyo (JP); Shigeo Kurotaka, Kanagawa (JP); Toshihiko Baba, Chiba (JP); Kazuhito Kishi, Kanagawa (JP); Eriko Konno, Iwate (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/448,356

(22) Filed: May 30, 2003

(65) Prior Publication Data

US 2004/0022552 A1 Feb. 5, 2004

(30) Foreign Application Priority Data

May 31, 2002 (JP) ..... 2002-160077
Apr. 23, 2003 (JP) ..... 2003-117777

(51) Int. Cl.
*G03G 15/20* (2006.01)

(52) U.S. Cl. ..... 399/328; 399/330

(58) Field of Classification Search ..... 399/320, 399/328, 329, 330, 333, 335
See application file for complete search history.

(56) References Cited

U.S. PATENT DOCUMENTS 4,920,250 A * 4/1990 Urban ..... 399/328 X
5,349,424 A * 9/1994 Dalal et al. ..... 399/329
5,697,036 A * 12/1997 Moser ..... 399/329
5,890,047 A * 3/1999 Moser ..... 399/329
6,055,390 A 4/2000 Kurotaka et al.
6,078,766 A 6/2000 Kurotaka
6,088,558 A 7/2000 Yamada et al.
6,144,832 A 11/2000 Nimura et al.
6,198,888 B1 3/2001 Kurotaka et al.
6,243,559 B1 6/2001 Kurotaka et al.
6,262,787 B1 7/2001 Kamoi et al.
6,263,181 B1 * 7/2001 Vaughan et al. ..... 399/329 X
6,304,740 B1 * 10/2001 Ciaschi et al. ..... 399/328

(Continued)

FOREIGN PATENT DOCUMENTS

| | | |
|---|---|---|
| JP | 8-129313 | 5/1996 |
| JP | 10-10919 | 1/1998 |
| JP | 10-133505 | 5/1998 |
| JP | 11-84933 | 3/1999 |
| JP | 3153732 | 1/2001 |
| JP | 2002-72731 | 3/2002 |

*Primary Examiner*—Sandra L. Brase
(74) *Attorney, Agent, or Firm*—Oblon, Spivak, McClelland, Maier & Neustadt, P.C.

(57) ABSTRACT

A fixing device included in an image forming apparatus for fixing a toner image formed on a sheet of the present invention includes a rotatable member and a pressing member forming a nip, which corresponds to a conveying zone, therebetween. The rotatable member and pressing member convey the sheet via the nip for thereby fixing the toner image on the sheet. A heating member heats the surface of the rotatable member in contact with therewith. Part of the rotatable member and part of the heating member contacting each other respectively have a convex shape and a concave shape complementary to the convex shape.

12 Claims, 21 Drawing Sheets

U.S. PATENT DOCUMENTS 6,347,212 B1 2/2002 Kosugi et al.
6,351,619 B1 * 2/2002 Yamada ..... 399/329 X
6,366,751 B1 4/2002 Shakuto et al.
6,442,365 B1 * 8/2002 Schlueter et al. ..... 399/328
6,501,935 B1 12/2002 Hirai et al.
6,535,701 B1 3/2003 Baba
6,542,705 B1 4/2003 Fujita et al.
6,559,421 B1 5/2003 Yura et al.
6,611,670 B1 * 8/2003 Chen et al. ..... 399/328
6,661,990 B1 * 12/2003 Pirwitz ..... 399/328

* cited by examiner

FIXING DEVICE HAVING A HEATING MEMBER AND IMAGE FORMING APPARATUS INCLUDING THE SAME

BACKGROUND OF THE INVENTION

1. Field of the Invention

The present invention relates to a copier, facsimile apparatus, printer or similar image forming apparatus and more particularly to a fixing device included in an image forming apparatus for heating a toner image carried on a sheet or recording medium.

2. Description of the Background Art

Generally, an image forming apparatus includes a fixing device configured to fix a toner image transferred to a sheet or recording medium with heat and pressure. A heat roller type of fixing system belongs to a family of conventional fixing devices and includes a heat roller and a press roller facing each other. The heat roller and press roller convey a sheet carrying a toner image therebetween to thereby fix the toner image with heat and pressure.

In the heat roller type of fixing system, a heat source may be disposed in the heat roller, as taught in, e.g., Japanese Patent No. 3,153,732 (column "0015, FIG. 1). Alternatively, a heat source may be positioned outside of the heat roller for heating the surface of the heat roller, as proposed in, e.g., Japanese Patent Laid-Open Publication Nos. 8-129313 (columns "0055" and "0056", FIG. 2) and 10-133505 (column "0110", FIG. 1).

Further, to promote rapid warm-up of the heat roller heated by the heat source, Japanese Patent Laid-Open Publication No. 11-84933 (column "0022", FIG. 1), for example, discloses a fixing device configured to sense the temperature of the heat roller at positions preceding and following a sheet conveying zone and feed, when a pressure difference reaches a preselected value, power to the heat source. Also, Japanese Patent Laid-Open Publication No. 2002-72731 (column "0049", FIG. 2), for example, proposes to provide the surface of a heating member with light absorbing capability. Further, Japanese Patent Laid-Open Publication No. 10-10919 (column "0033", FIG. 1), for example, proposes to feed power to the heat source when the surface temperature of a heating member drops below a preselected value.

However, the conventional fixing devices cannot surely prevent the surface temperature of the heating member from dropping, particularly in the sheet conveying zone or nip, extending the warm-up time of the heating member.

SUMMARY OF THE INVENTION

It is an object of the present invention to provide a fixing device capable of obviating temperature drop to thereby reduce the warm-up time and maintain preselected fixing temperature at all times, and an image forming apparatus including the same.

A fixing device included in an image forming apparatus for fixing a toner image formed on a sheet of the present invention includes a rotatable member and a pressing member forming a nip, which corresponds to a conveying zone, therebetween. The rotatable member and pressing member convey the sheet via the nip for thereby fixing the toner image on the sheet. A heating member heats the surface of the rotatable member in contact with therewith. Part of the rotatable member and part of the heating member contacting each other respectively have a convex shape and a concave shape complementary to the convex shape.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
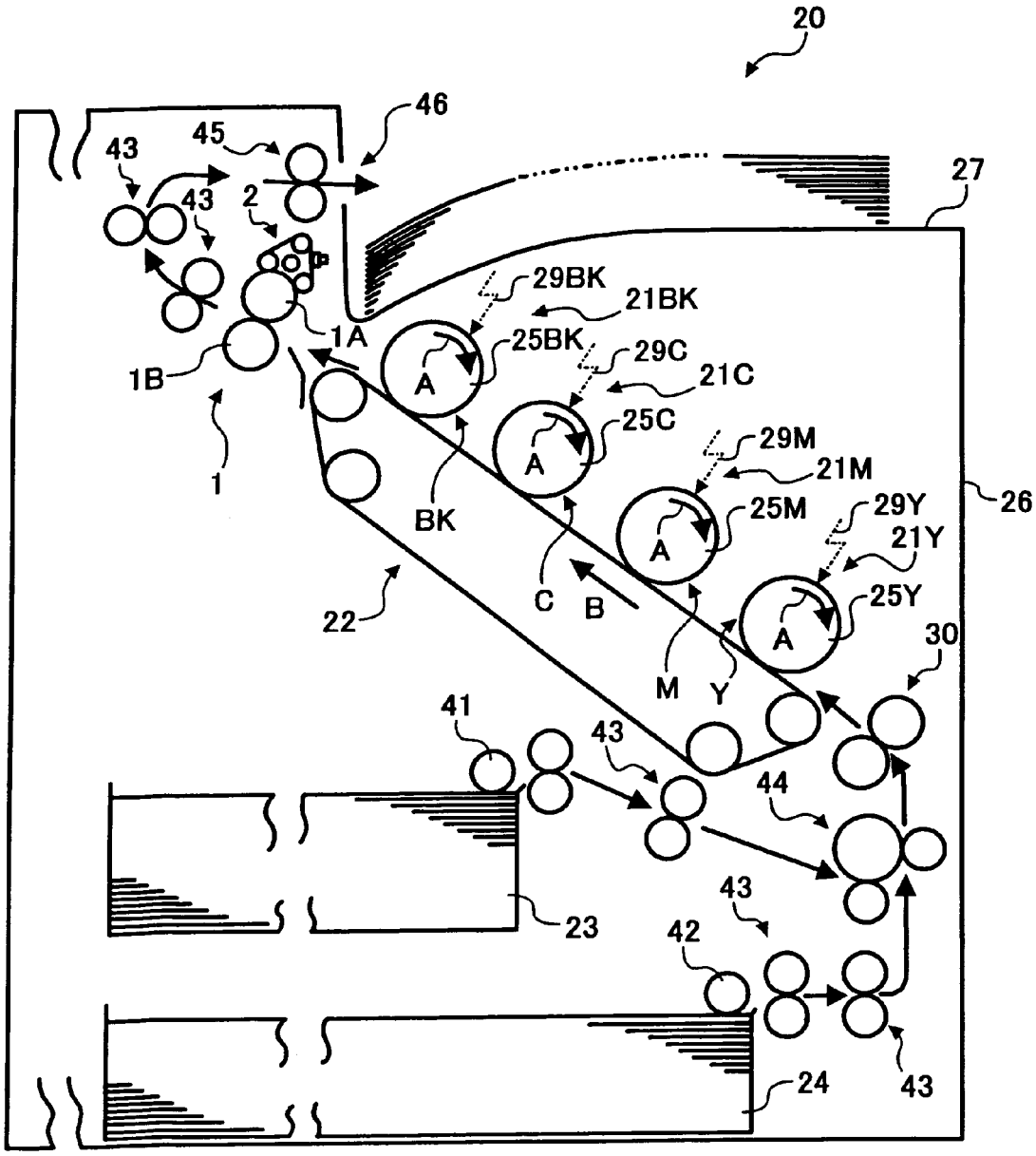
FIG. 1 is a view showing an image forming apparatus to which a fixing device in accordance with the present invention is applied.

Referring to FIG. 1 of the drawings, an image forming apparatus to which a fixing device in accordance with the present invention is shown. The image forming apparatus may be implemented as any one of a color copier, a color printer, a facsimile apparatus capable of operating in the same manner as the color copier or the color printer, and a monochromatic copier, printer or facsimile apparatus.

As shown in FIG. 1, the image forming apparatus, generally 20, includes image forming devices 21Y (yellow), 21M (magenta), 21C (cyan) and 21Bk (black) each for forming an image in a particular color in accordance with image data. An image transferring device 22 faces the image forming devices 21Y through 21Bk. Sheet cassettes or sheet feeding devices 23 and 24 each are loaded with a particular kind of sheets or recording media to be fed to an image transfer region where the image forming devices 21Y through 21BK and image transferring device 22 face each other. A registration roller pair 30 conveys the sheet fed from the sheet cassette 23 or 24 in synchronism with image formation effected by the image forming devices 21Y through 21Bk. A fixing device 1 fixes a toner image transferred to the sheet at an image transfer position.

Recording media applicable to the apparatus 20 include plain papers customary with, e.g., a copier, OHP (OverHead Projector) sheets, cards, postcards and other thick sheets belonging to the at least 90K, 100 g/cm$^2$ class, and envelopes and other special sheets greater in thermal capacity than sheets.

Because the image forming devices 21Y through 21Bk are identical in configuration with each other except for the color of toner to use, the following description will concentrate on the image forming device 21Y by way of example. The image forming device 21Y includes a photoconductive drum 25Y, which is a specific form of an image carrier, rotatable in a direction A. Sequentially arranged around the drum 25Y in the direction A are a charger, a developing device, a cleaning device and other conventional process units. Scanning means with a polygonal mirror scans the drum 25Y with a light beam 29Y at a position between the charger and the developing device.

The drum 25Y may be replaced with a photoconductive belt, if desired. It is to be noted that in the image forming device 21Bk, a light beam 29Bk may be implemented as two beams, so that the image forming device 21Bk can form an image at higher speed than the other image forming devices 21Y, 21M and 21C.

The sheet cassettes 23 and 24 are respectively loaded with sheets of size A4 and sheets of size A3, which are elongate in the right-and-left direction as viewed in FIG. 1. The image transferring device 22 is inclined so as to reduce the overall size of the apparatus 20 in the right-and-left direction in FIG. 1. More specifically, a casing 26 included in the apparatus 20 has a width slightly greater than the lengthwise dimension of a sheet of size A3 in the right-and-left direction in FIG. 1. The top of the casing 26 is implemented as a stack tray 27 to which a sheet, carrying a toner image thereon and passed through the fixing device 1, is driven out.

Pickup rollers 41 and 42 are respectively associated with the sheet cassettes 23 and 24 for paying out the sheets. Roller pairs 43 convey the sheet thus paid out from the sheet cassette 23 or 24 toward the registration roller pair 30. An outlet roller pair 45 drives the sheet out of the casing 26 toward the stack tray 27 via an outlet 46.

Figure 19:
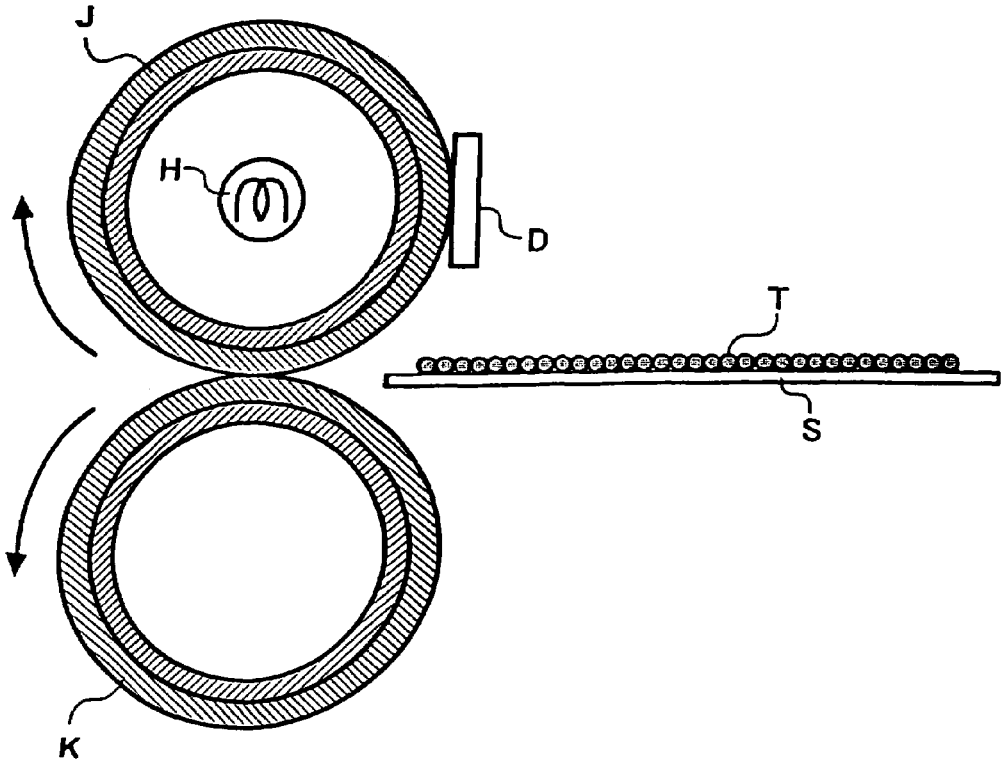
FIG. 19 PRIOR ART
FIGS. 19 through 21 are views each showing a particular conventional fixing device.

To better understand the present invention, brief reference will be made to conventional fixing systems. Generally, a fixing roller must have its surface maintained at preselected temperature and is heated by a heat source for such a purpose. FIG. 19 shows a conventional internal heating system in which a heat source H is disposed in a fixing roller J. Labeled K and S in FIG. 19 are a press roller and a sheet carrying a toner image T thereon, respectively. A temperature sensor D senses the surface temperature of the fixing roller J. Power is controllably fed to the heat source H in accordance with the output of the temperature sensor D.

The internal heating system described above has a problem that the metallic core of the fixing roller J must be thick enough to serve as the rigid member of the roller J and is therefore apt to increase thermal capacity, resulting in low heat conduction efficiency to the surface of the roller J.

Figure 20:
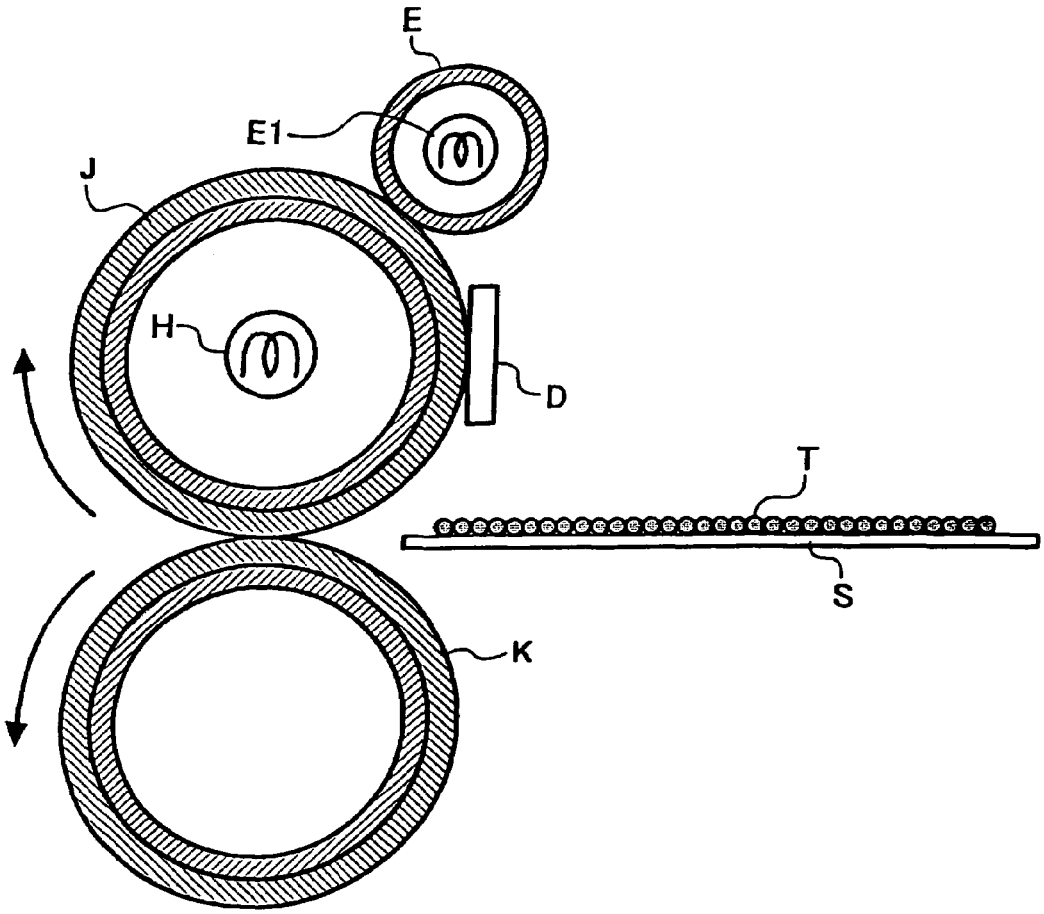
FIG. 20 PRIOR ART
Figure 21:
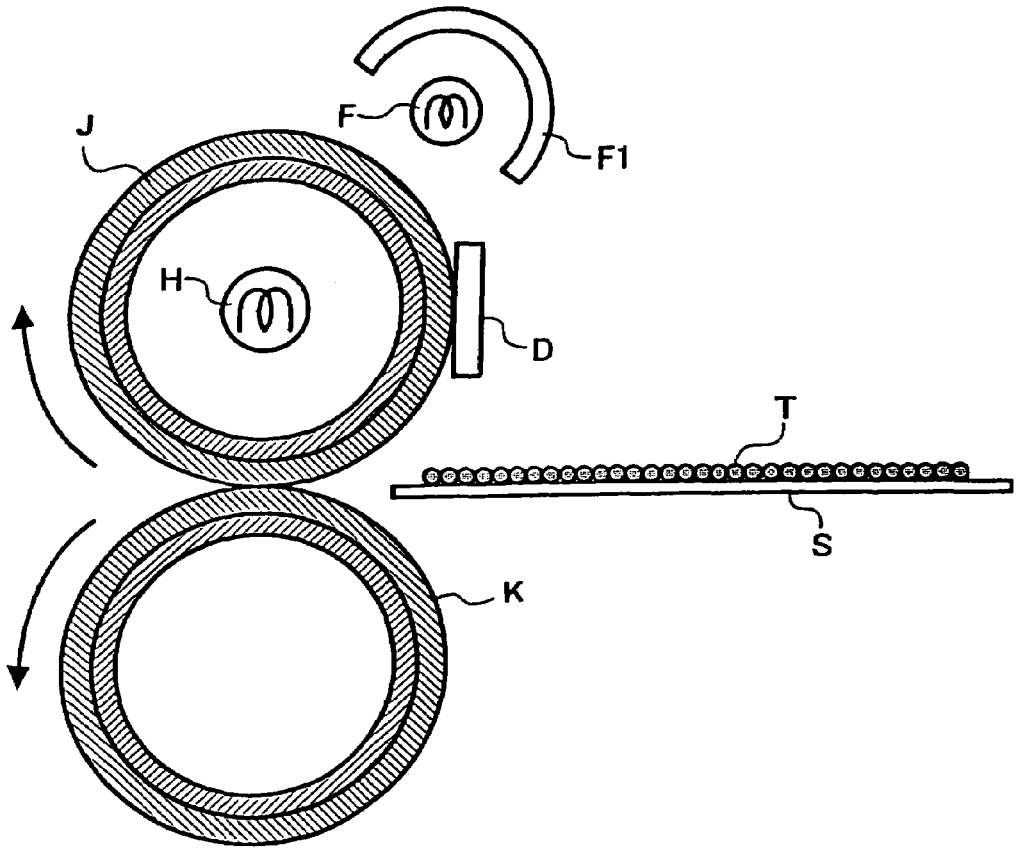
FIG. 21 PRIOR ART

An external heating system solves the above problem by locating a heating section outside of the fixing roller and heating only the surface of the fixing roller. FIG. 20 shows a specific external heating system including a heat source H disposed in the fixing roller J and a heat roller E that accommodates a heat source E1. The heat roller E is held in contact with the fixing roller J for transferring heat to the surface of the roller J. FIG. 21 shows another specific external heating system in which a heat source F is positioned in the vicinity of the fixing roller J and heats the surface of the roller J with radiant heat. Labeled F1 in FIG. 21 is a reflector.

The external heating system shown in FIG. 20 has a problem that the area over which the rollers J and E contact each other is small due to the curvatures of the rollers J and E, resulting in low heat conduction efficiency. To solve this problem, an elastic heat-insulating layer deformable when pressed may be included in the fixing roller J. However, when the heat-insulating layer is formed of a foam material, the foam portion having a heat-insulating function is crushed due to deformation and loses the expected function. As a result, the surface temperature of the fixing roller J noticeably drops.

The external heating system shown in FIG. 21 has a problem that an air layer between the heat source F and the fixing roller J lowers heat conduction efficiency and prevents the surface of the roller J from being rapidly warmed up.

Further, when an unmovable, external heating member is held in contact with a fixing roller, the heating member heats only part of the fixing roller. This brings about a problem that when the fixing roller is locally heated while in a halt, it is apt to catch fire. It is therefore necessary to dispose a heat source in the fixing roller, too, and selectively use this heat source and an external heat source to thereby protect the fixing roller from local heating. This, however, cannot be done without resorting sophisticated configuration and control.

The fixing device of the present invention prevents the heat-insulating effect from decreasing by obviating, e.g., the elastic deformation of the surface of a fixing roller, thereby solving the problems stated above.

Figure 2:
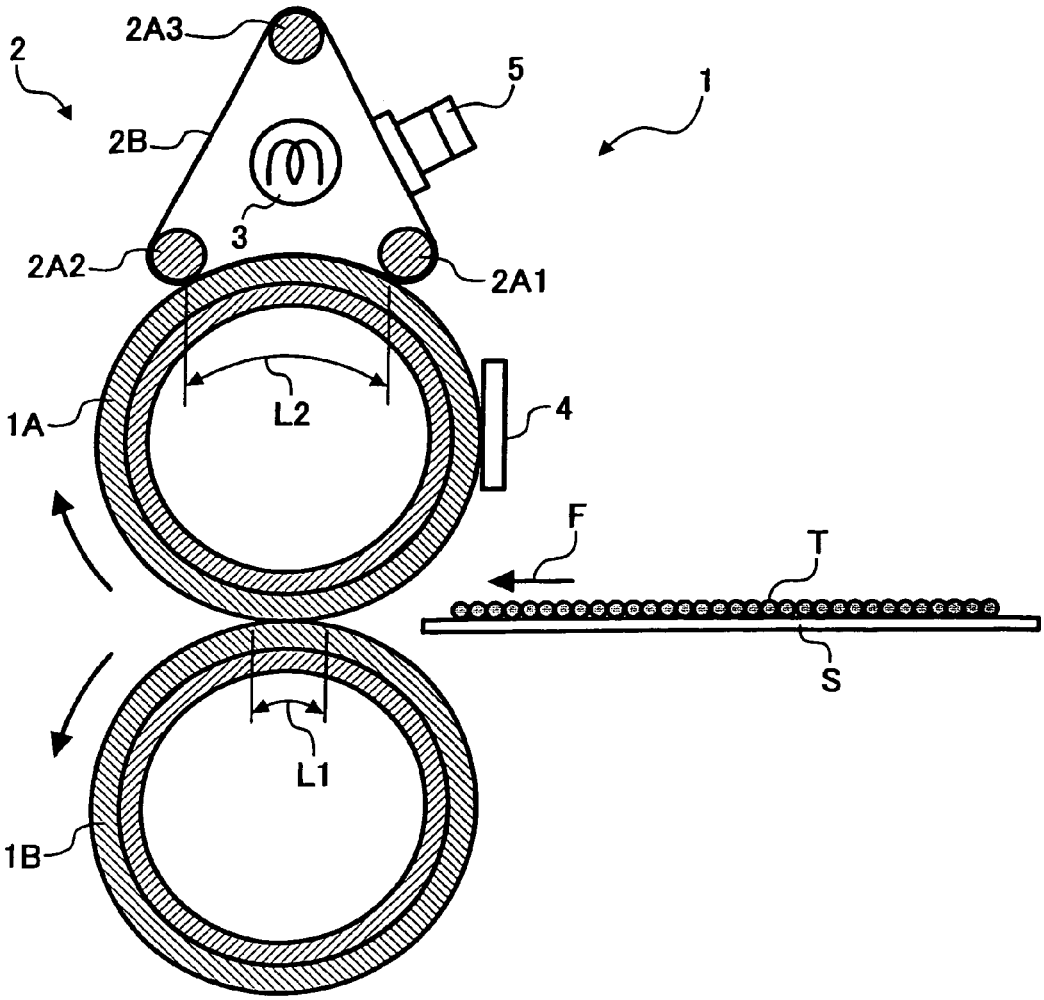
FIG. 2 is a view showing a first embodiment of the fixing device in accordance with the present invention.

Referring to FIG. 2, a first embodiment of the fixing device in accordance with the present invention is shown and generally designated by the reference numeral 1. As shown, the fixing device 1 includes a fixing roller or rotatable member 1A, a press roller B, and an external heating member 2. The fixing roller 1A is a fixing member capable of contacting a toner image carried on a sheet being conveyed. The press roller 1B is a pressing member pressed against the fixing roller 1A, forming a nip between the rollers 1B and 1A. The external heating member (simply heating member hereinafter) 2 heats the fixing roller 1A.

It is noteworthy that while the fixing roller 1A and press roller 1B both are members applied to a heat roller heating system, they do not accommodate a heat source therein, as illustrated.

The fixing roller 1A is made up of a metallic core formed of iron (Fe), a heat insulating layer formed on the core and implemented by foam silicone, liquid silicone or foam ceramic, and a parting layer surrounding the heat insulating layer and implemented by, e.g., a PFA tube. If desired, a heat conduction layer formed of foil of nickel or stainless steel (SUS) may intervene between the heat insulating layer and the parting layer.

The press roller 1B is made up of a metallic core also formed of iron, an elastic layer formed of foam silicone or liquid silicone by way of example, and a parting layer covering the elastic layer and implemented by, e.g., a PFA tube.

The external heating member 2 includes an endless belt 2B passed over a plurality of rollers 2A1 through 2A3 and movable while partly contacting the circumference of the fixing roller 1A. In this configuration, the fixing roller 1A constitutes a rotatable member having a convex circumference, so that the belt 2B has a concave contact surface complementary to the convex circumference of the roller 1A. To implement the concave contact surface, the belt 2B may be replaced with a roller provided with an elastic layer, if desired. Stated another way, the belt 2B included in the heating member 2 is made concave in place of the fixing roller or rotatable member 1A. It follows that even when an elastic layer including a foam portion is present in the fixing roller 1A, the foam portion is prevented from being crushed or losing the heat-insulating function.

In the illustrative embodiment, the rollers 2A1 and 2A2 should only rotate by following the rotation of the fixing roller 1A in the opposite direction to the fixing roller 1A. If desired, either one of the rollers 2A1 and 2A2 may be driven by a drive source, not shown, so as to move the belt 2B independently of the fixing roller 1A. Further, the belt 2B may be configured to slide on the fixing roller 1A without following the rotation of the fixing roller 1A.

Part of the belt 2B is pressed against the fixing roller 1A by the rollers 2A1 and 2A2 positioned at both sides in the direction in which the belt 2B extends along the surface of the roller 1A. The belt 2B is therefore capable of moving while uniformly contacting the surface of the fixing roller 1A. In this sense, the rollers 2A1 and 2A2, positioned side by side and causing the belt 2B to extend along the surface of the fixing roller 1A, play the role of members for pressing the belt 2A against the fixing roller 1A. Alternatively, part of the belt 2B between the rollers 2A1 and 2A2 may be pulled upward so as to be concave complementarily to the convex surface of the fixing roller 1A without contacting the roller 1A.

In the illustrative embodiment, the belt 2B is made up of a base implemented by 30 $\mu$m to 100 $\mu$m thick foil of nickel, stainless steel or similar metal. The inner surface of the base is painted black in order to enhance absorption efficiency by obviating the reflection of light. Further, a 20 $\mu$m to 50 $\mu$m thick surface layer formed of silicon rubber or fluorine-containing resin is formed on the surface of the belt 2B that contacts the fixing roller 1A, protecting the fixing roller 1A from damage.

As stated above, in the illustrative embodiment, the rotatable member and heating member contact each other in a convex and a concave shape, respectively. Therefore, when the rotatable member includes an elastic layer including a foam portion, the foam portion is prevented from being crushed or losing the expected heat insulating function. It follows that temperature at the nip between the two members is prevented from dropping and lowering fixing efficiency. In addition, because the position where a sheet begins to be nipped and conveyed is also included in the heating zone, a sheet entered this zone is immediately heated to preselected fixing temperature.

A halogen heater or similar heat source 3 that radiates heat is disposed in the loop of the belt 2B and controlled in synchronism with the movement, i.e., rotation of the fixing roller 1A. More specifically, power is fed to the heat source 3 substantially in unison with the rotation of the fixing roller 1A.

If a roller (belt) is continuously heated for 5 seconds or more while stopped, then the belt is heated to 300° C. or above and has its base or surface layer deformed or degenerated, as determined by experiments. Further, if the roller is continuously heated for 10 seconds or more while stopped, it catches fire, as also determined by experiments. While continuously heating the roller in a halt for 2 seconds or less does not matter from a safety standpoint, it makes the temperature of the belt irregular and therefore brings about irregular fixation. It is therefore important to feed power to a heat source substantially in unison with the rotation of the roller. While the illustrative embodiment sets a specific condition on power feeding or heating timing, it is not necessary that the roller (belt) be stopped when power feed is interrupted for cooling. The issue to be addressed is that the problems stated above do not arise. It is to be noted that the duration of rotation of the roller (belt) after the interruption of power feed is open to choice.

Figure 3:
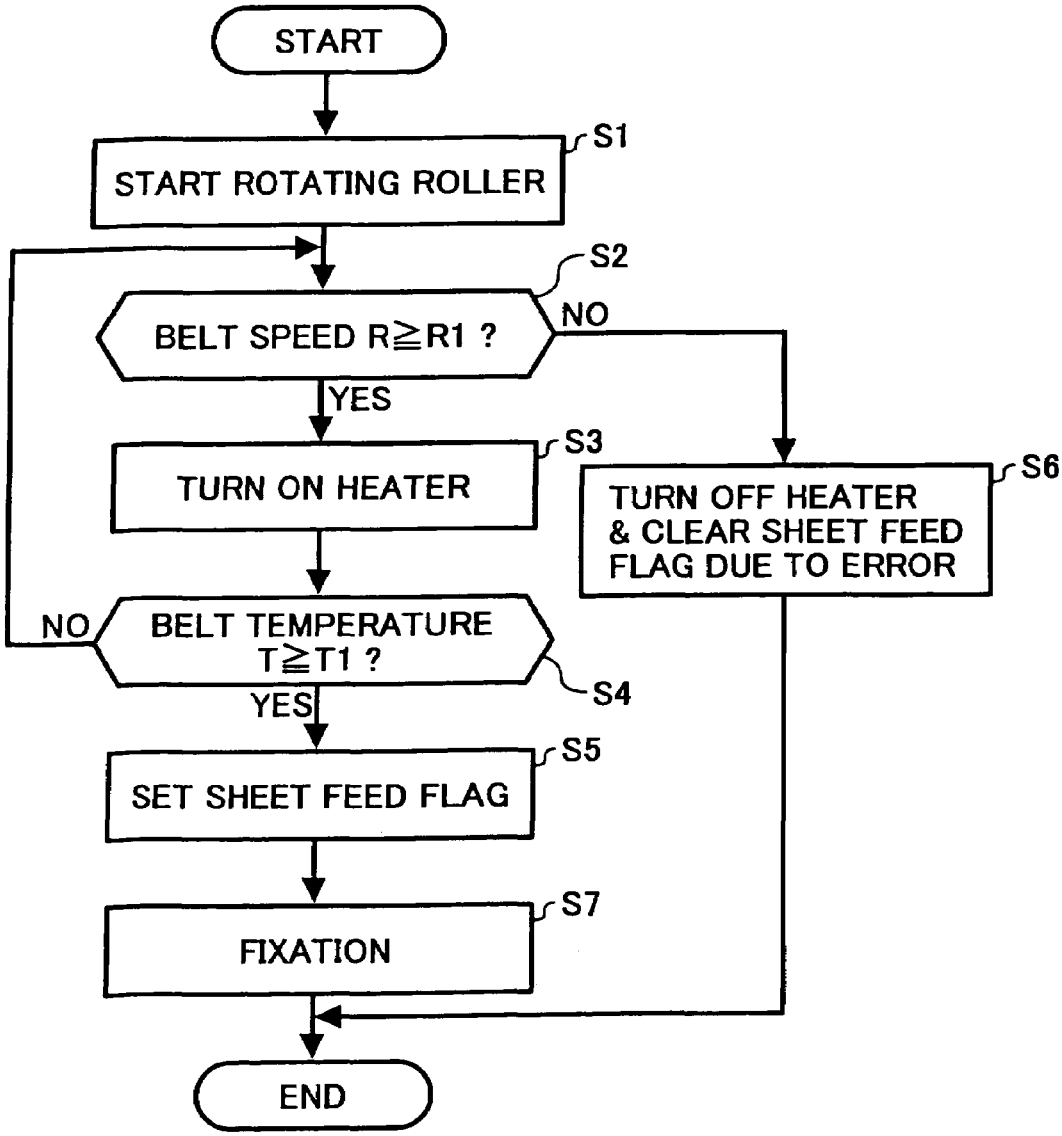
FIG. 3 is a flowchart showing a specific power feed control procedure unique to the first embodiment.
Figure 4:
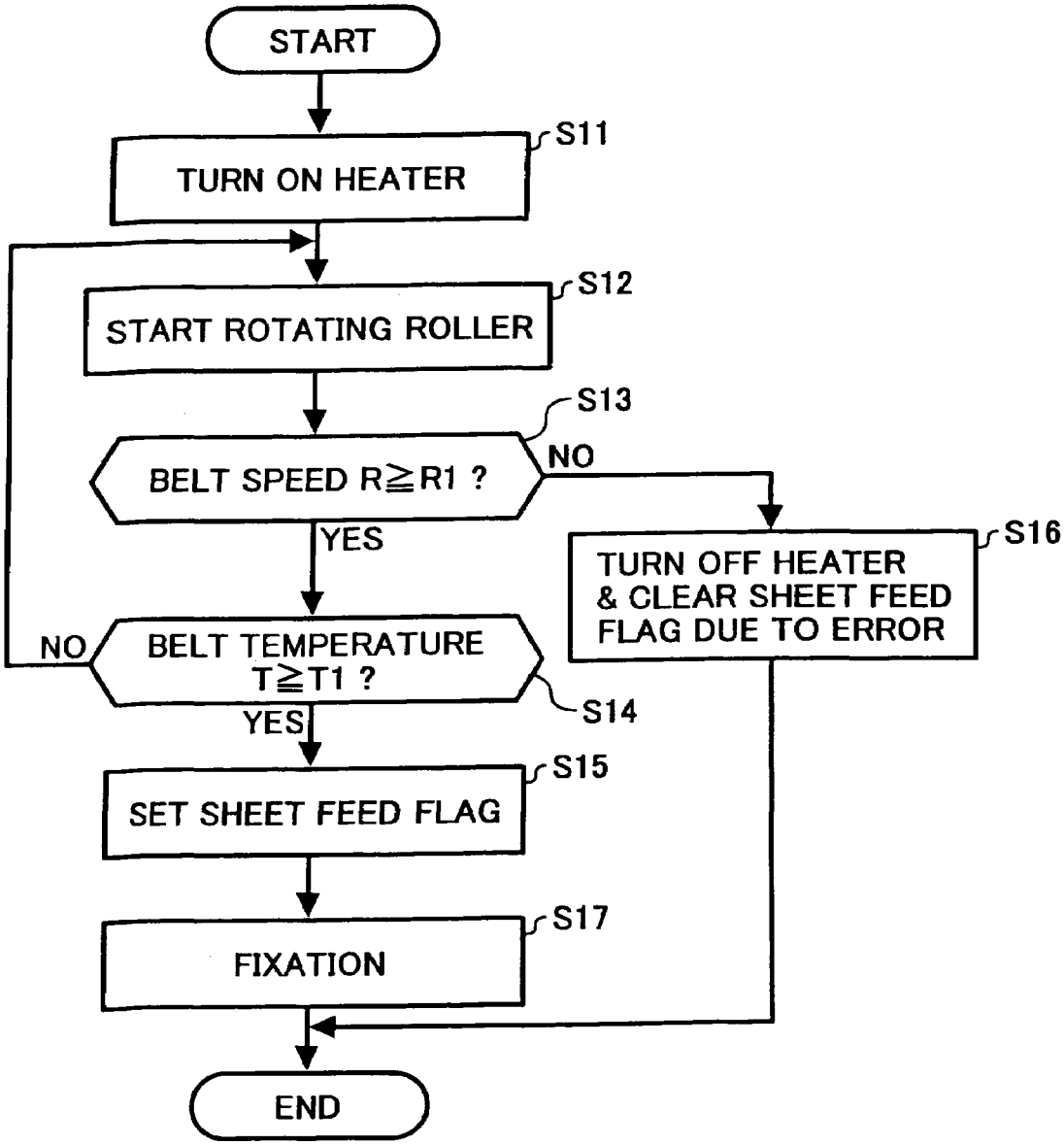
FIG. 4 is a flowchart showing another specific power feed control procedure.

FIGS. 3 and 4 each show a particular procedure relating to the timing of power feed to the heat source 3, i.e., synchronous turn-on. In FIGS. 3 and 4, the movement of the belt is regarded as turning, and the number of turns of the belt will be referred to as a rotation speed. In this sense, to control the amount of heat to be radiated from the heat source 3, the rotation speed of the fixing roller or rotatable member 1A may be sensed.

As shown in FIG. 3, the roller starts rotating in response to a print command (step S1). If the rotation speed R of the belt is higher than or equal to a reference rotation speed R1 (Yes, step S2), then the heater is turned on (step S3). Subsequently, if the temperature T of the belt is higher than or equal to reference temperature T1 (Yes, step S4), a sheet feed flat is set (step S5), and then fixation is executed (step S7). If the answer of the step S4 is No, the procedure returns to the step S2. If the answer of the step S2 is No, meaning that the rotation speed R of the belt is lower than the reference rotation speed R1 despite the start of rotation, then the operation is interrupted because slip, sheet jam or similar error may have occurred (step S6). In the step S6, the heater is turned off while the sheet feed flag is cleared.

In the specific procedure shown in FIG. 4, after the heater has been turned off (step S11), the roller is caused to start rotating (step S12). The procedure of FIG. 4 differs from the procedure of FIG. 3 in that the belt speed is sensed (step S13) before the belt temperature T is sensed (step S14).

The control over power feed to the heat source 3 may be based on a speed ratio between the fixing roller 1A and the belt 2B instead of the rotation of the fixing roller 1A. More specifically, the amount of heat based on the speed ratio between the fixing roller 1A and the belt 2B is used to reflect how frequently the new surface of the belt 2B faces the fixing roller 1A; the amount of heat transferred to the fixing roller 1A varies with such frequency. For example, when the belt 2B moves at higher speed than the fixing roller 1A, the chance that the new surface of the belt 2B, transferred heat to the fixing roller 1A and again heated by the heat source 3, faces the fixing roller 1 A increases, so that the amount of heat transferred to the roller 1A increases. When the above relation between the speeds is inverted, the amount of heat absorbed by the belt 2B increases. For this reason, power fed to the heat source 3 and therefore the amount of heat may be controlled on the basis of the speed ratio, so that an amount of heat required of the heat roller 1A can be achieved.

As for the control over the temperature of belt 2B, simple ON/OFF control is apt to aggravate temperature ripple on the belt surface and therefore bring about irregular fixation. It is therefore preferable to delicately control a mean amount of heat for a unit period of time stepwise by using duty control, phase control or inverter control relating the ON/OFF timing of the heat source 3, thereby equalizing the surface temperature of the fixing roller 1A and that of the belt 2B. Further, the amount of heat may be controlled in accordance with both of the rotation speed of the fixing roller 1A and that of the belt 2B. Such control over the amount of heat is practicable even when the belt 2B, serving as the external heating member 2, is replaced with a convex surface contacting the fixing roller 1A.

As shown in FIG. 2, a temperature sensor 4 is held in contact with the surface of the fixing roller 1A and senses the surface temperature of the roller 1A. A controller, not shown, controls power feed to the heat source 3 in accordance with the output of the temperature sensor 4. A thermostat or similar safety device 5 is associated with the belt 2B for preventing the temperature of the belt 2B from rising to an excessive degree. With the thermostat 5, it is possible to interrupt power feed to the heat source 3 when the belt 2B is apt to catch fire.

As stated above, the amount of heat is controlled in accordance with the temperature of the fixing roller sensed by the temperature sensor 4, i.e., a mean amount of heat generated by the heat source 3 for a unit period of time is increased or decreased in accordance with the above temperature. Therefore, the temperature of the fixing roller 1A, which varies with the rotation speed of the fixing roller 1A, can be delicately corrected, equalizing the surface temperature of the roller 1A. This obviates defective fixation ascribable to temperature drop. Further, the heat source 3 assigned to the belt or external heating member 2, which is movable in association with the movement of the fixing roller 1A in contact with the roller 1A, is controlled in synchronism with the movement of the fixing roller 1A. This prevents the fixing roller 1A from being excessively heated when, e.g., it is stopped due to an error. Particularly, the heating condition set in synchronism with the movement of the fixing roller 1A is matched not only to the ON/OFF of the heat source 3 but also to the speed ratio between the fixing roller 1A and the belt 2B. This makes it possible to optimize the transfer of heat from the belt 2B in accordance with the condition in which the fixing roller 1A moves, and therefore to match the rise of the temperature of the fixing roller 1A and the maintenance of the temperature to conditions necessary for fixation.

In FIG. 2, the belt 2B contacts the fixing roller 1A over a particular length, as will be described hereinafter. Assume that the nip width over which the fixing roller 1A and press roller 1B nip and convey a sheet S in a direction F is L1, and that the belt 2B contacts the fixing roller 1A over a length L2 in the direction of movement of the roller 1A. Then, the illustrative embodiment establishes a relation of $L1 \leqq L2$.

The above relation $L1 \leqq L2$ is selected to guarantee a period of time over which the fixing roller 1A and belt 2B are required to contact each other for replenishing an amount of heat lost by the nip width. More specifically, in the nipping and conveying zone having the length L1, the temperature of the fixing roller 1A is simply absorbed by the sheet S and lowered thereby. Therefore, by replenishing heat over a period of time longer than the period of time over which the temperature drops, it is possible to restore the temperature to the fixing temperature. Assume that such a period of time necessary for heat replenishment is implemented by a roller instead of by a belt. Then, assuming that a length corresponding to the contact length of the belt 2B is a circumferential length, the roller must be provided with an extremely large radius of curvature that would increase thermal capacity and would thereby slow down temperature elevation.

Furthermore, the belt 2B, passed over the rollers 2A1 and 2A2, is simply held in contact with the surface of the fixing roller 1A in a concave shape complementary to the convex shape of the roller 1A. The surface of the fixing roller 1A is therefore protected from local deformation; otherwise, the foam portion of the heat insulating layer included in the fixing roller 1A would be crushed to degrade heat insulation. In this manner, the illustrative embodiment allows the fixing roller 1A to be efficiently heated to the fixing temperature and stably maintained thereat.

Why the belt 2B is passed over three rollers 2A1 through 2A3 is that the belt 2B needs a roundabout way for implementing the contact length L2.

A modification of the illustrative embodiment will be described with reference to FIG. 5. As shown, the rollers 2A1 through 2A3 over which the belt 2B is passed each are provided with a heat-insulating cover layer R on the circumference that contacts the belt 2B. The cover layer R prevents heat from being transferred from the belt 2B to the roller for thereby reducing the amount of heat of the belt 2B to be lost. This allows the heat of the belt 2B to be efficiently transferred to the fixing roller 1A and therefore reduces the warm-up time of the fixing roller 1A to the fixing temperature.

Figure 5:
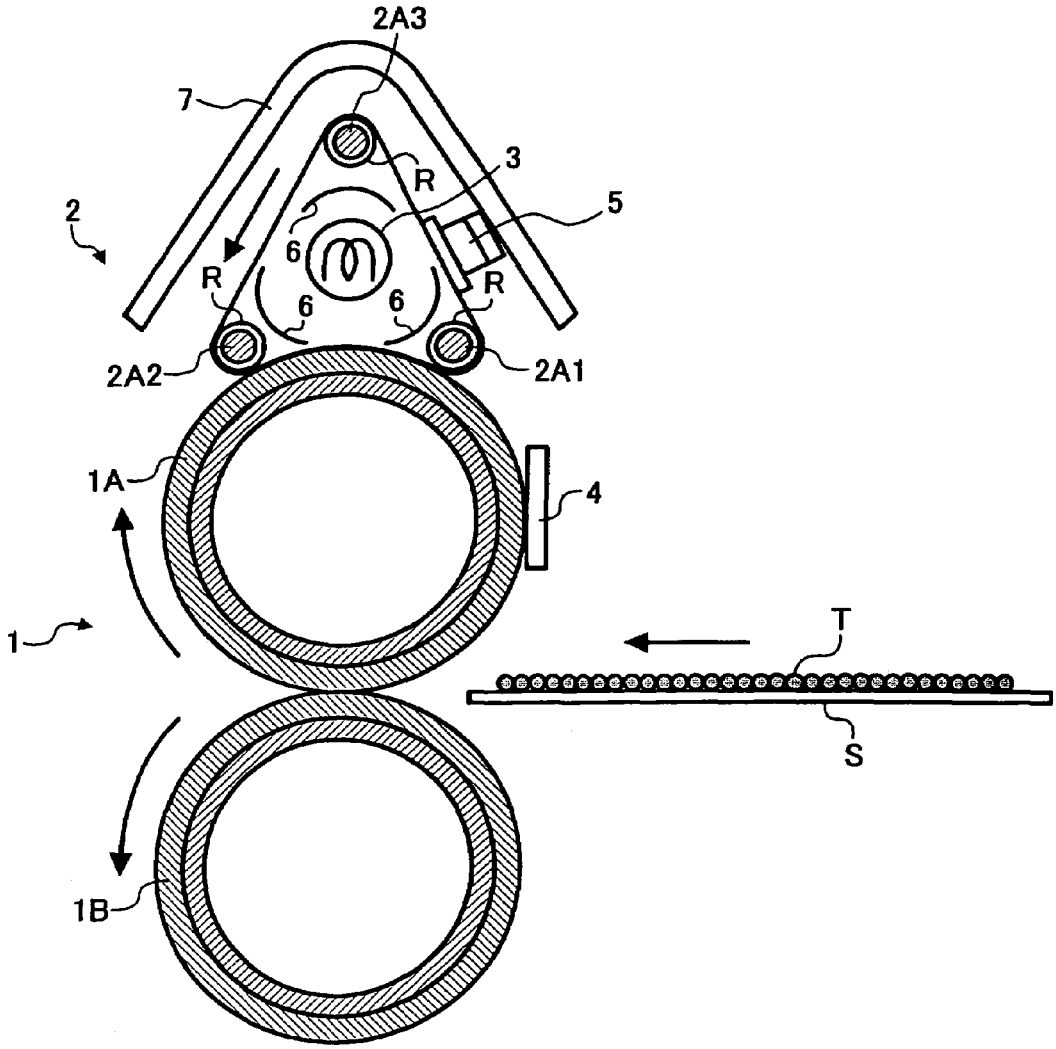
FIG. 5 is a view showing a modification of the first embodiment.

As shown in FIG. 5, screening members 6 are positioned between the heat source 3 and the rollers 2A1 through 2A3 in order to prevent heat radiated from the heat source 3 from reaching the rollers 2A1 through 2A3, so that the radiant heat of the heat source 3 can be effectively transferred only to the belt 2B. Further, a screening plate 7 surrounds the belt 2B except for the portion of the belt 2B facing the fixing roller 1A and is spaced from the belt 2B by a distance of 0.5 mm to 1 mm, obviating heat radiation from the belt 2B to the atmosphere. More specifically, the space between the screening plate 7 and the belt 2B is warmed by heat radiated from the belt 2B and therefore reduces temperature gradient between the belt 2B and the atmosphere, thereby preventing the temperature of the belt 2B from dropping.

The modification described above promotes efficient heat transfer from the heat source 3 to the belt 2B for thereby preventing power consumption by the heat source 3 from increasing.

Figure 6B:
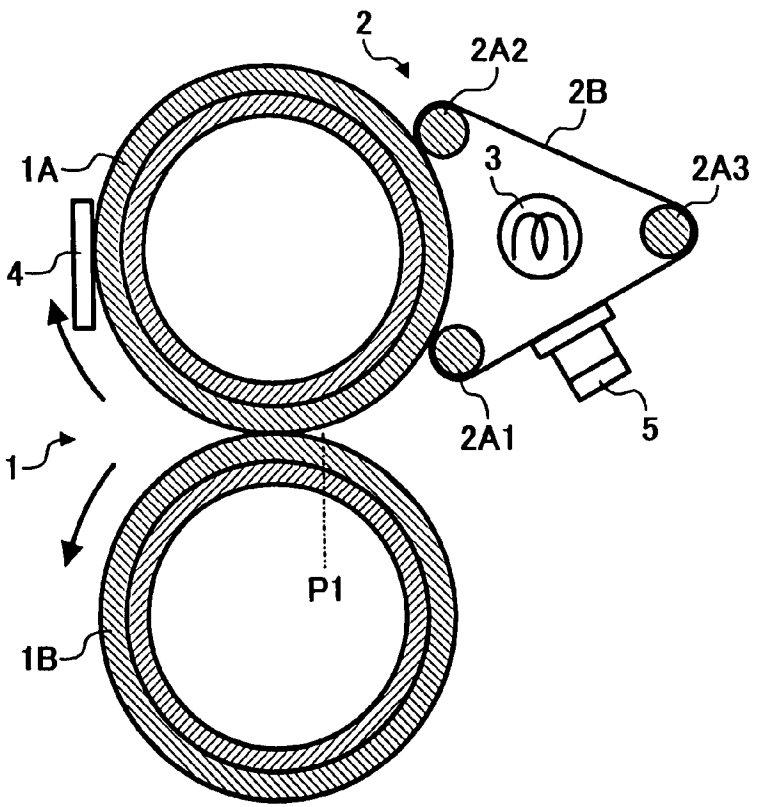
FIGS. 6A and 6B are views showing a second embodiment of the present invention.
Figure 6A:
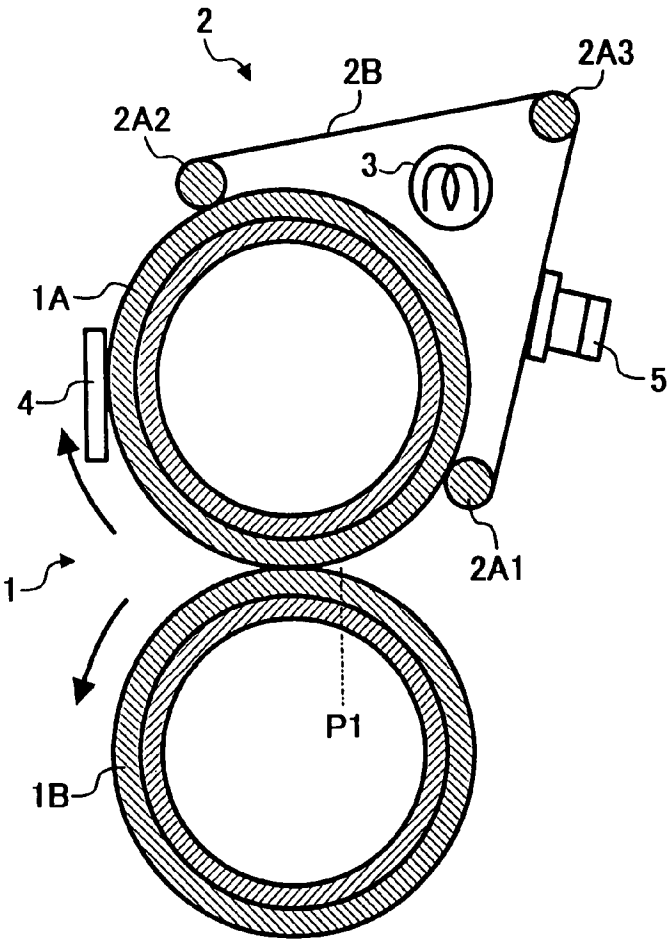

Reference will be made to FIGS. 6A and 6B, which correspond to FIG. 2, for describing a second embodiment of the fixing device in accordance with the present invention. As shown, the heating zone where the belt 2B and fixing roller 1A contact each other includes a portion close to the conveyance start position included in the conveyance starting zone, which is formed by the fixing roller 1A and press roller 1B. In the illustrative embodiment, the roller 2A1 differs from the roller 2A1 of the previous embodiment in that it adjoins the conveyance start position, labeled P1, where the fixing roller 1A and press roller 1B face each other.

In FIG. 6A, the roller 2A2, cooperating with the roller 2A1 to hold the belt 2B in contact with the fixing roller 1A, is shown as being located at the same position as in FIG. 2. In FIG. 6B, the roller 2A2 is shifted from the roller 2A2 of FIG. 2 such that the belt 2B contacts the fixing roller 1A over the same length as in FIG. 2, but at a position shifted in phase from the position of FIG. 2 toward the conveyance start position P1. The relation $L1 \leqq L2$ stated earlier with reference to FIG. 2 also holds in both of the configurations of FIGS. 6A and 6B.

As stated above, the portion close to the conveyance start position is included in the heating zone of the external heating member 2, so that the heat radiation path to the conveyance start position is minimized. This successfully minimizes the temperature drop of the fixing roller 1A.

Particularly, when sheet conveying speed is high, the contact length L2 of the belt or heat inlet 2B must be increased relative to the nip width or heat outlet L1 in order to guarantee the heat transfer time. In this sense, the belt 2B may be passed over the rollers 2A1 through 2A3 in the condition shown in FIG. 6A.

In the illustrative embodiment, the length L2 over which the belt 2B contacts the fixing roller 1A is selected to be equal to or greater than the nip width, or the length of conveying zone, L1 between the fixing roller 1A and the press roller 1B, as stated above. It is therefore possible to guarantee a period of time necessary for replenishing heat absorbed by a sheet, thereby surely restoring the preselected temperature. Further, the above contact length is achievable without increasing the size of the fixing device. This, coupled with the fact that the foam portion of the fixing roller 1A is prevented from being crushed and losing the heat insulating function, prevents the surface temperature from dropping and therefore reduces the warm-up time. Moreover, the heating zone includes even the conveyance start position and therefore reduces the heat radiating portion, so that a sheet reaching the conveyance start position can be quickly heated to the fixing temperature.

Figure 7:
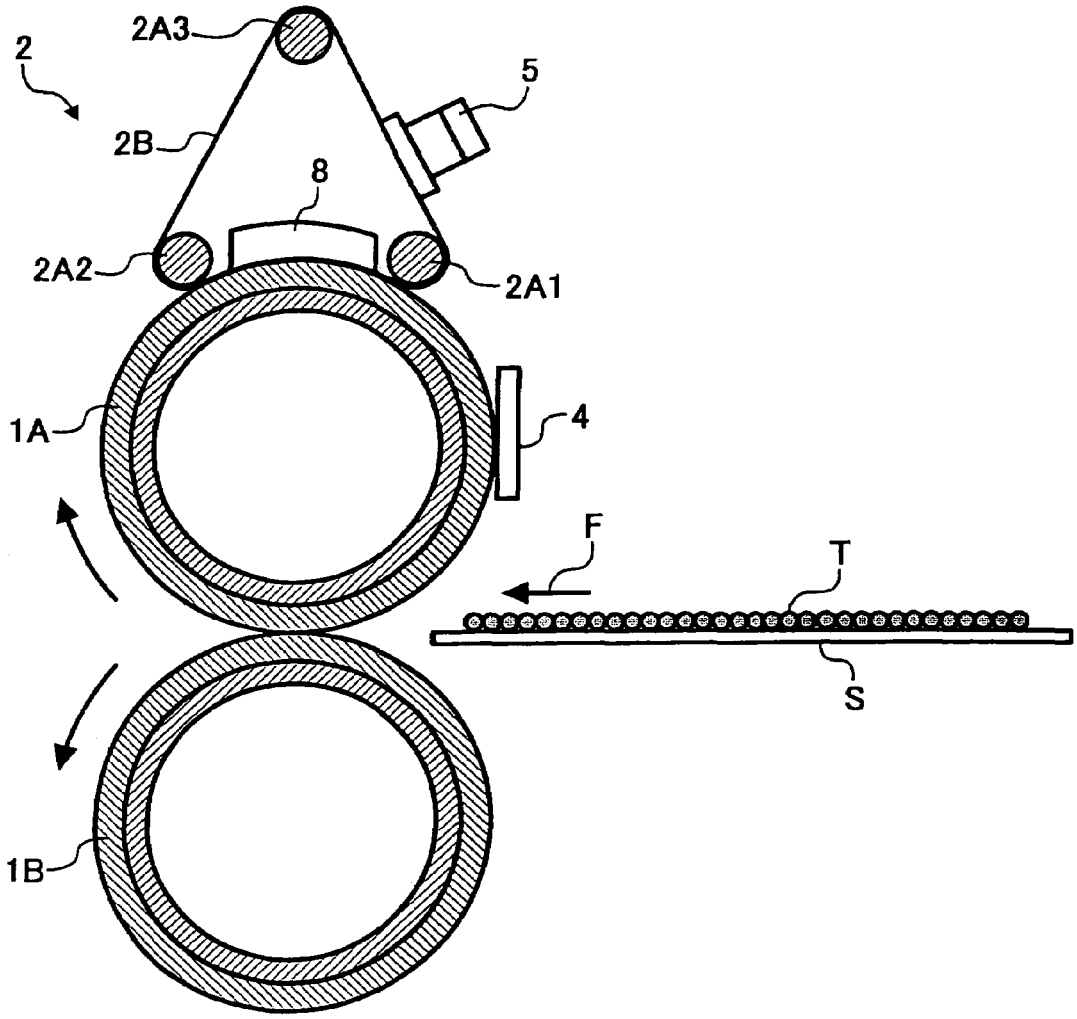
FIG. 7 is a view showing a third embodiment of the present invention.

FIG. 7, which also corresponds to FIG. 2, shows a third embodiment of the fixing device in accordance with the present invention. As shown, the illustrative embodiment includes a planar pressing member 8 in addition to the rollers 2A1 through 2A2 of FIG. 2. The planar pressing member 8 is disposed in the loop of the belt 2B and faces the fixing roller 1A with the intermediary of the belt 2B. In the illustrative embodiment, the pressing member 8 is implemented as a planar, heat generating body or resistance heating body. The planar heat generating body is made up of a resistor implemented by a ceramic heater or metal foil and sandwiched between heat-resistant insulating layers formed of, e.g., polyimide. The pressing member 8 therefore plays the role of a heat source directly contacting the belt 2. This is why the heat source 3 is absent.

As stated above, in the illustrative embodiment, the member that presses the belt 2B serves as a heat source at the same time. This, coupled with the fact that direct heat transfer is substituted for radiation, makes it unnecessary to use a special member as a pressing member and reduces the space to be occupied by the heat source, compared to the case wherein radiant heat is used. It is therefore possible to reduce the apparatus cost and the period of time necessary for the fixing roller to reach the fixing time while, after the roller has reached the fixing time, minimizing temperature variation.

Figure 8:
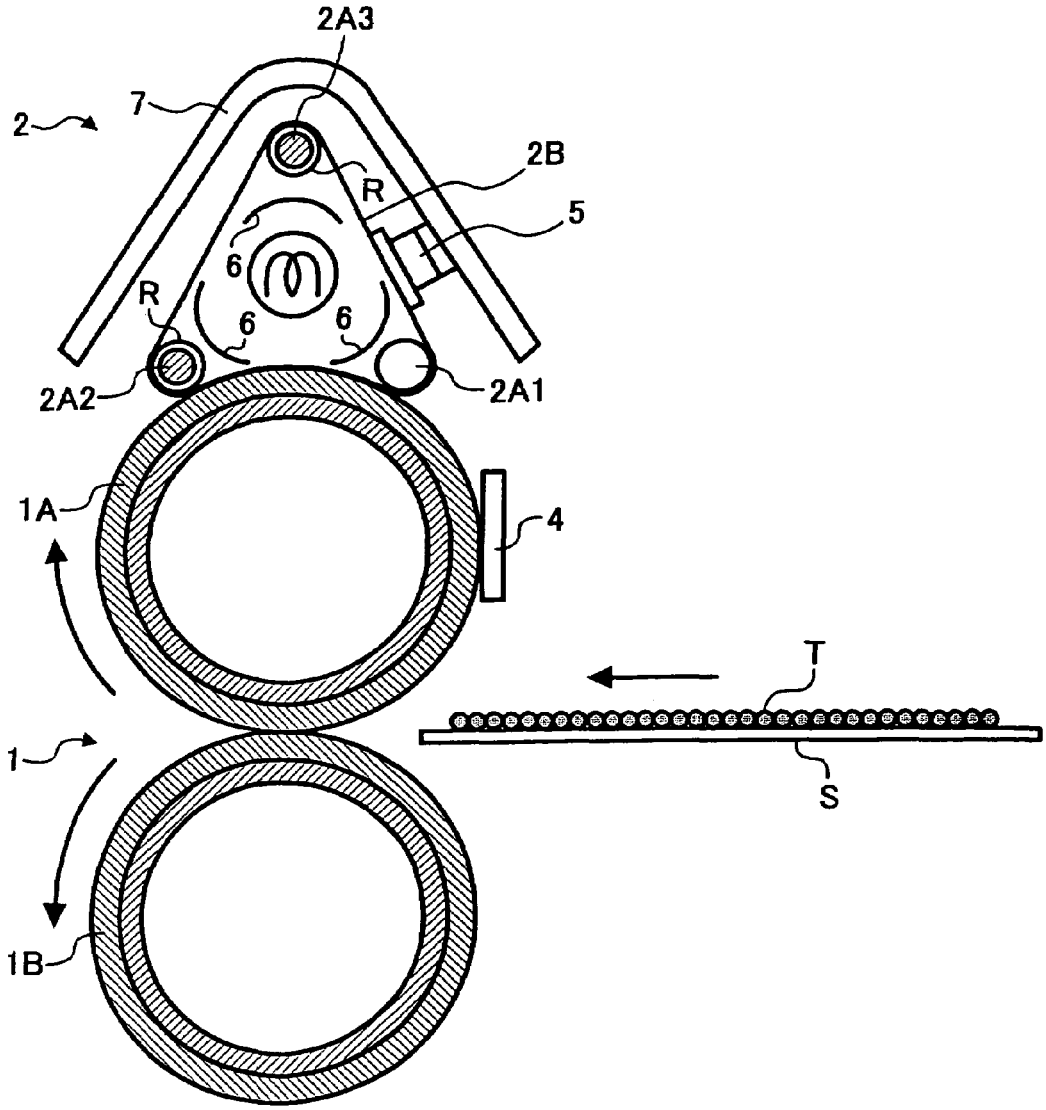
FIG. 8 is a view showing a fourth embodiment of the present invention.

FIG. 8, which corresponds to FIG. 5, shows a fourth embodiment of the fixing device in accordance with the present invention. Briefly, the illustrative embodiment assigned particular drive torque to each of the rollers 2A1 and 2A2. More specifically, drive torque assigned to the downstream roller 2A1 in the direction of movement of the belt 2B is selected to be heavier than drive torque assigned to the upstream roller 2A2. Particularly, the surface of the downstream roller 2A1 is provided with a larger coefficient of friction than the surface of the upstream roller 2A2. It is to be noted that the term "drive torque" covers rotation load implemented by a slide bearing and acting on a roller that follows the rotation of another member as well.

When the roller 2A2 is driven by the same drive source, not shown, as the roller 2A1, drive torque may be varied on the basis of a speed reduction ratio in a drive transmission mechanism. On the other had, when a particular drive source is assigned to each of the rollers 2A1 and 2A2, the output torque of the drive sources may be varied from each other.

In the illustrative embodiment, the downstream roller 2A1, driven by heavier drive torque than the upstream roller 2A2, applies tension to the belt 2B. Therefore, when the rollers 2A1 and 2A2 are positioned closer to the axis of the fixing roller 1A than the belt 2B, the belt 2B is pressed against the surface of the fixing roller 1A. Consequently, the contact of the belt 2B with the fixing roller 1A is insured by using the structure supporting the belt 2B, i.e., without resorting to any special pressing structure, so that heat transfer from the belt 2B to the roller 1A is enhanced.

A modification of the illustrative embodiment will be described hereinafter. In the modification, the roller 2A1 closer to the conveyance start position than the roller 2A2 is formed of aluminum or similar good heat conductor and differs from the other roller 2A2 in that it is not provided with the cover layer R. The roller 2A1 can therefore maintain the temperature distribution in the axial direction uniform. More specifically, the sheet size to be dealt with is not constant in the axial direction of the fixing roller 1A. For example, when the sheet size occupies only a narrow range in the axial direction, the temperature distribution in the axial direction varies with the result that the supply and demand of heat on the belt 2B is disturbed. The roller 2A1 formed of a good heat conductor obviates the above problem. Particularly, when the roller 2A2 is formed of pure aluminum, temperature gradient in the axial direction is rapidly canceled, so that the temperature distribution in the axial direction is maintained uniform.

In the embodiment shown in FIG. 8, a moving mechanism, not shown, selectively moves the belt 2B into or out of contact with the fixing roller 1A, i.e., causes the former to contact the latter only when the latter is driven. The moving mechanism may be configured to move the shafts of the rollers 2A1 through 2A3 toward or away from the fixing roller 1A or may be implemented as pivotable arms supporting the belt 2B and having points of action positioned at the rollers 2A1 and 2A2. In any case, heat transfer to the fixing roller 1A does not occur during the warm-up of the belt 2B, so that the warm-up time of the belt 2B is reduced.

Figure 9:
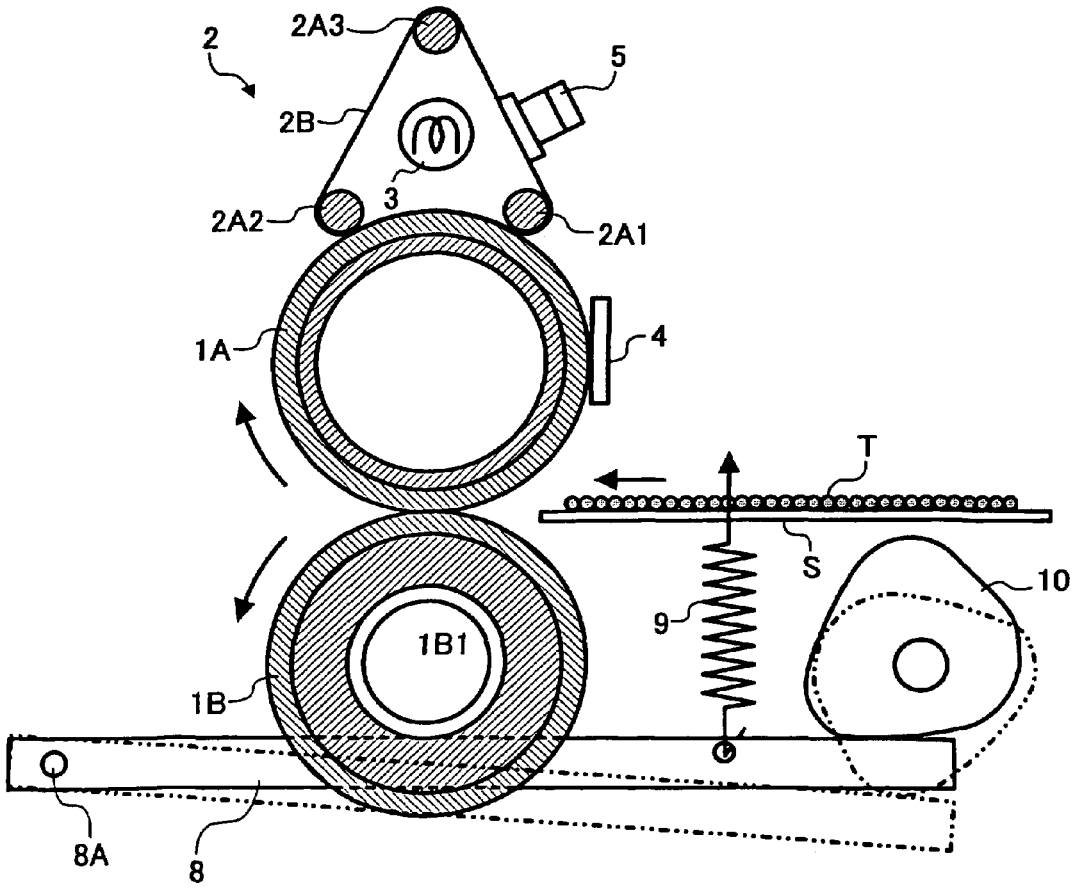
FIG. 9 is a view showing a fifth embodiment of the present invention.

FIG. 9 shows a fifth embodiment of the present invention and corresponds to FIG. 2. As shown, the press roller 1B is movable into and out of contact with the fixing roller 1A and moved away from the fixing roller 1A when the fixing roller 1A is warmed up. More specifically, a lever 8 is pivotable about a shaft 8A at one end and held in contact with the shaft 1B1 of the press roller 1B at the other end. A spring or biasing member 9 constantly biases the lever 8 such that the press roller 1B tends to move toward the fixing roller 1A.

A cam 10 is held in contact with the end of the lever 7 remote from the shaft or fulcrum 8A and driven by a motor, not shown, to move the lever 8 such that the press roller 1B selectively moves into or out of contact with the fixing roller 1A. The cam 10 maintains the press roller 1B spaced from the fixing roller 1A via the lever 8 during the warm-up time of the fixing roller 1A, i.e., up to the time when the surface temperature of the fixing roller 1A reaches the fixing temperature. This timing corresponds to the start-up of the fixing device 1.

In the illustrative embodiment, it is also possible to control the contact pressure between the press roller 1B and the fixing roller 1A on the basis of the rotation phase of the cam 10. The control over the contact means control over the sheet nipping force. It follows the fixing roller 1A can desirably contact a toner image and efficiently transfer heat to the toner image.

Further, the press roller 1B is spaced from the fixing roller 1A up to the time when the surface temperature of the fixing roller 1A rises to the fixing temperature, as stated above. In this condition, heat transferred from the external heating member 2 to the fixing roller 1A is not absorbed by the press roller or another member 1B at all, insuring rapid warm-up of the fixing roller 1A.

Figure 10:
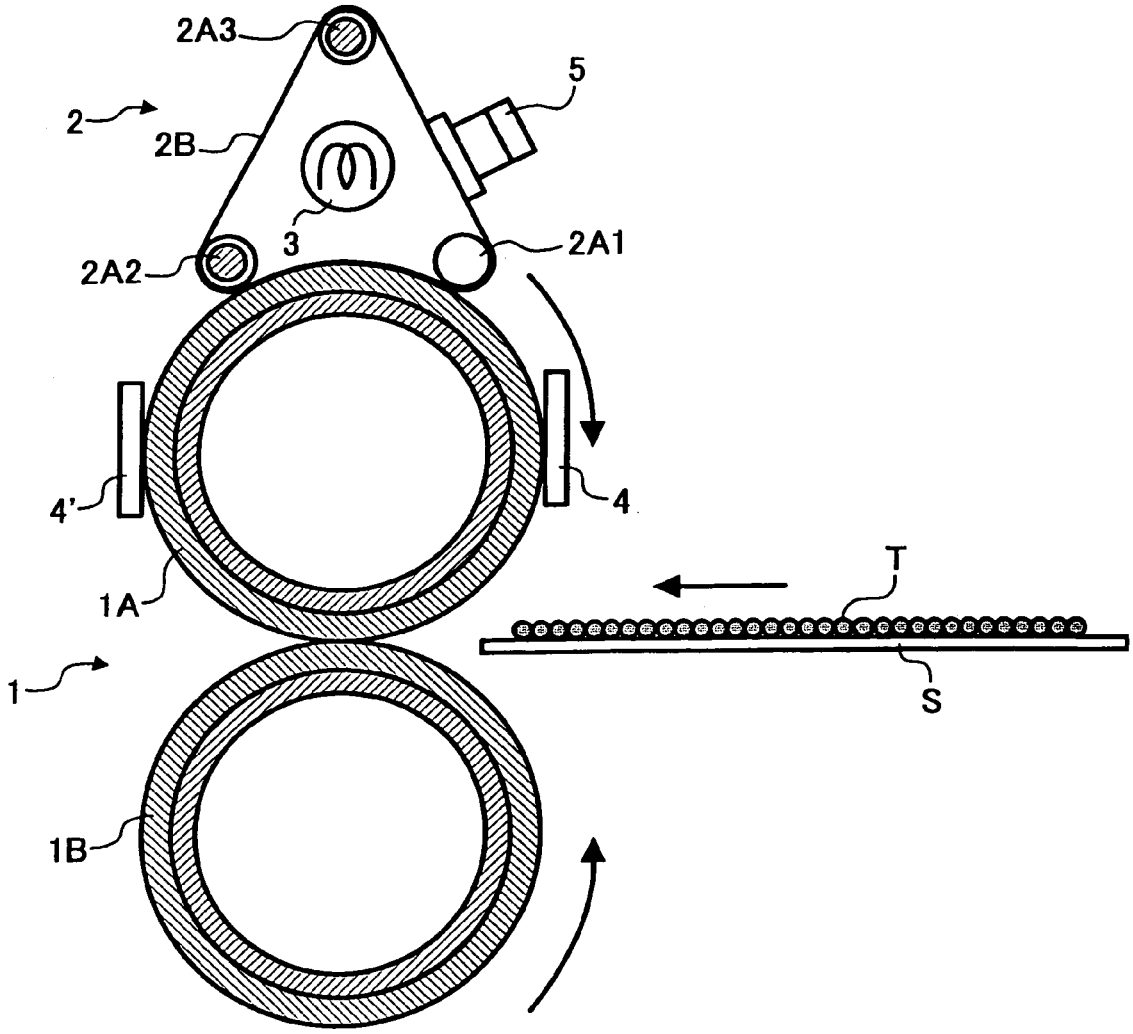
FIG. 10 is a view showing a sixth embodiment of the present invention.

A sixth embodiment of the present invention will be described with reference to FIG. 10 corresponding to FIG. 2. As shown, the illustrative embodiment controls the temperature of the fixing roller 1A by using two temperature sensors 4 and 4', which are respectively positioned upstream and downstream of the nip. The temperature sensor 4 senses the surface temperature of the fixing roller 1A moving toward the nip while the temperature sensor 4' senses the surface temperature of the fixing roller 1A transferred its heat to a sheet. In this configuration, an amount of heat absorbed by the sheet is determined on the basis of a difference between the outputs of the temperature sensors 4 and 4'. The heat source 3 is caused to generate an amount of heat for making up for the amount of heat lost. More specifically, the amount of heat to be replenished, i.e., power for implementing it is related to temperature difference by a controller, not shown, beforehand, so that the heat source 3 is controlled in accordance with the temperature difference. This frees the fixing roller 1A from temperature variation for thereby maintaining the fixing temperature constant at all times.

Figure 11:
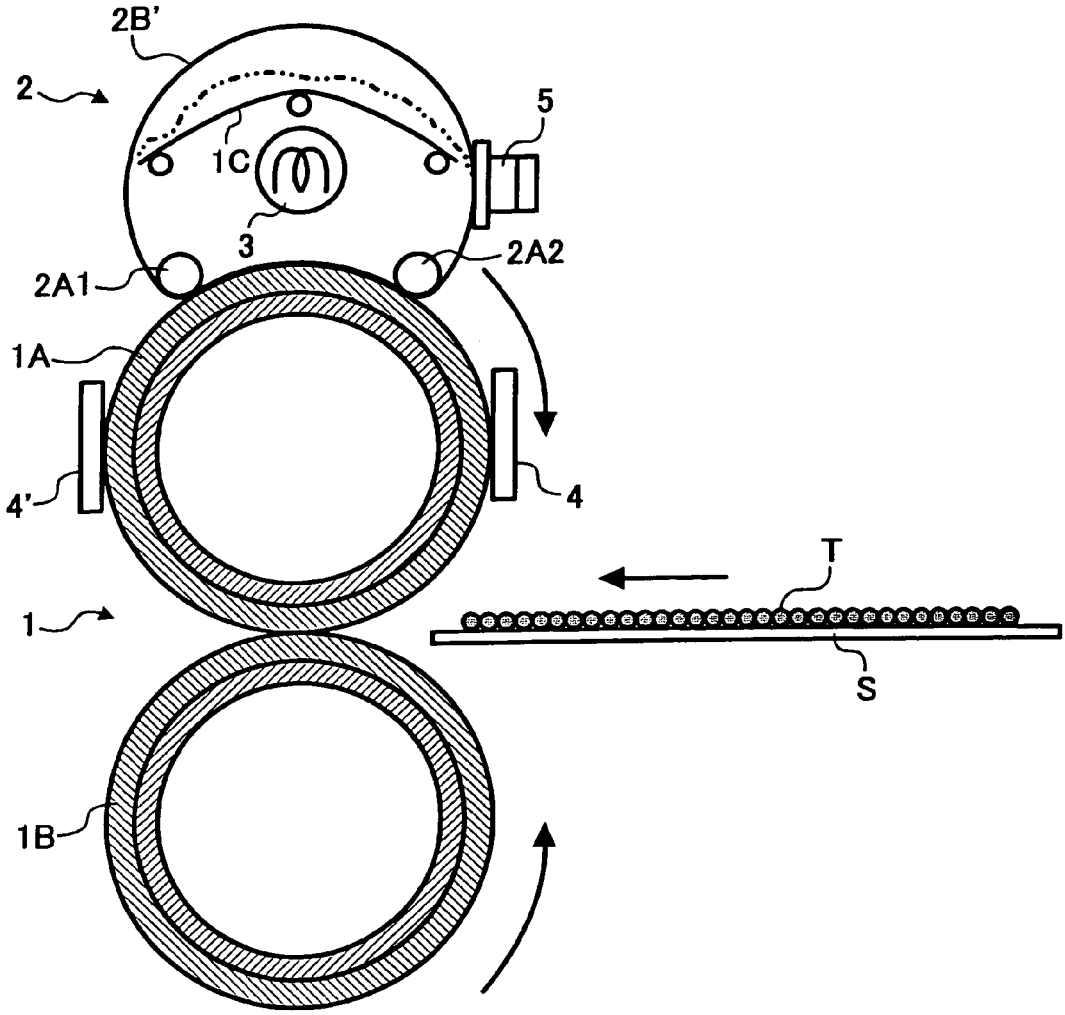
FIG. 11 is a view showing a modified form of an endless belt included in the illustrative embodiments.

FIG. 11 shows a modified form of the belt implementing the external heating member 2. As shown, the belt, labeled 2B', is formed of a material that allows it to remain in a loop shape due to its own bending rigidity. The belt 2B' is passed only over the rollers 2A1 and 2A2 positioned side by side in the circumferential direction of the fixing roller 1A. In this case, the rollers 2A1 and 2A2 simply maintain the belt 2B' in contact with the surface of the fixing roller 1A.

A receiving portion 1C should preferably be positioned between the upper portion of the belt 2B' and the heat source 3 from the safety standpoint. When the upper portion of the belt 2B' accidentally bends downward, as indicated by a phantom line in FIG. 11, the receiving portion 1C receives the belt 2B' while guiding its movement. The belt 2B' is therefore prevented from contacting the heat source 3 and catching fire.

Figure 12:
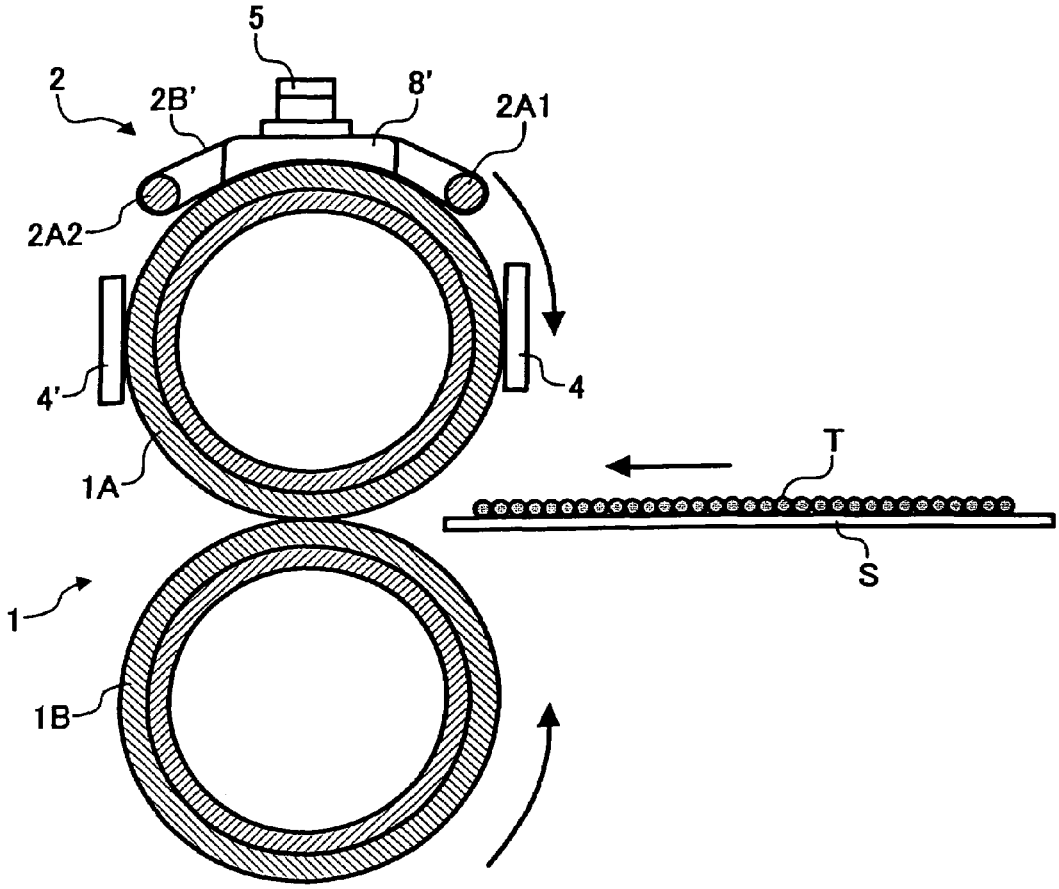
FIG. 12 is a view showing a modified form of a heat source included in the illustrative embodiments.

FIG. 12 shows a modified form of the heat source. As shown, the belt, labeled 2B' is movable around the outer periphery of a planar heat source 8' and passed over the rollers 2A1 and 2A2 positioned side by side in the circumferential direction of the fixing roller 1A. The rollers 2A1 and 2A2 are positioned closer to the axis of the fixing roller 1A than the belt 2B' as in the configuration of FIG. 9, pressing the belt 2B against the fixing roller 1A. In this modification, the planar heat generating body 8' heats the opposite runs of the belt 2B' at the inside of the loop of the belt 2B', promoting rapid warm-up of the fixing roller 1A.

Various modifications of the structural elements of the fixing device will be described hereinafter.

FIGS. 13 through 16 show the modifications of the fixing member and pressing member. The fixing member or the pressing member in each modification is implemented as a belt.

Figure 13:
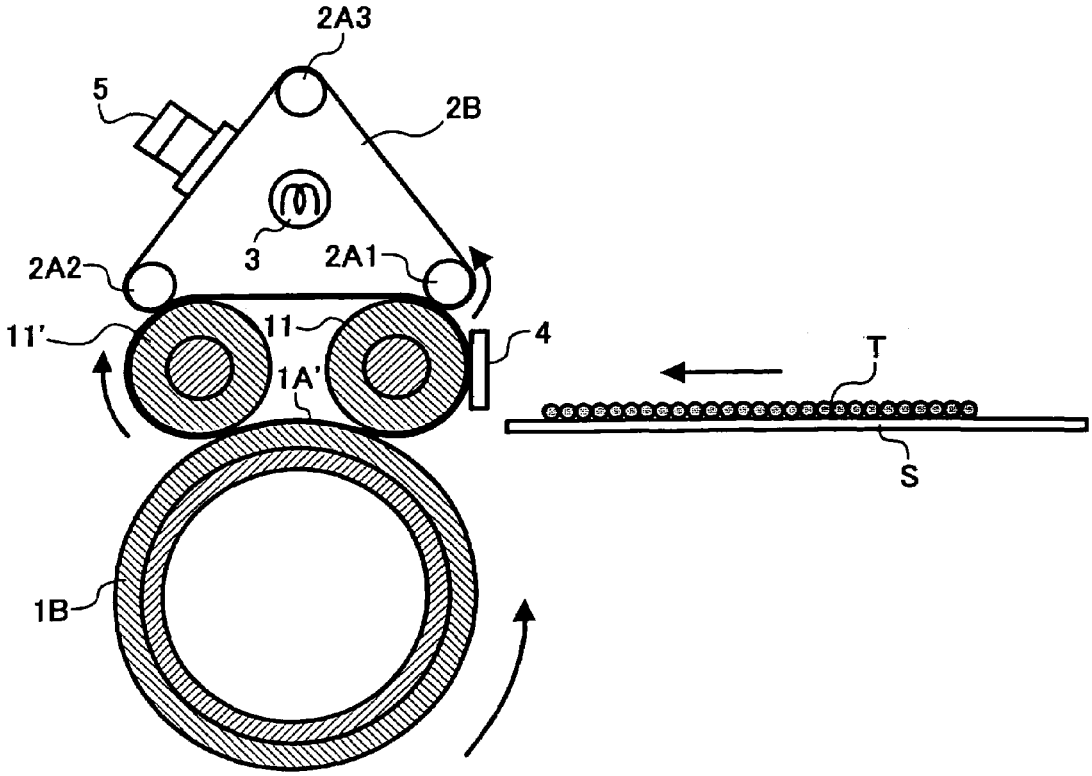
FIG. 13 is a view showing a modification of a fixing member and an external heating member included in the illustrative embodiments.

In the modification shown in FIG. 13, the fixing member is implemented as a belt 1A' passed over rollers 11 and 11'. One of opposite runs of the belt 1A' with respect to the rollers 11 and 11' is held in contact with the press roller 1B while the other run is held in contact with the belt 2B of the external heating member 2. The belt 2B is passed over the rollers 2A1 and 2A2 spaced from each other by a greater distance than the rollers 11 and 11', so that the rollers 2A1 and 2A2 are slightly shifted toward the press roller 1B on the circumferences of the rollers 11 and 11', respectively. Consequently, the belt 2B is held in close contact with the belt 1A' and can move together with the belt 1A'.

Figure 14:
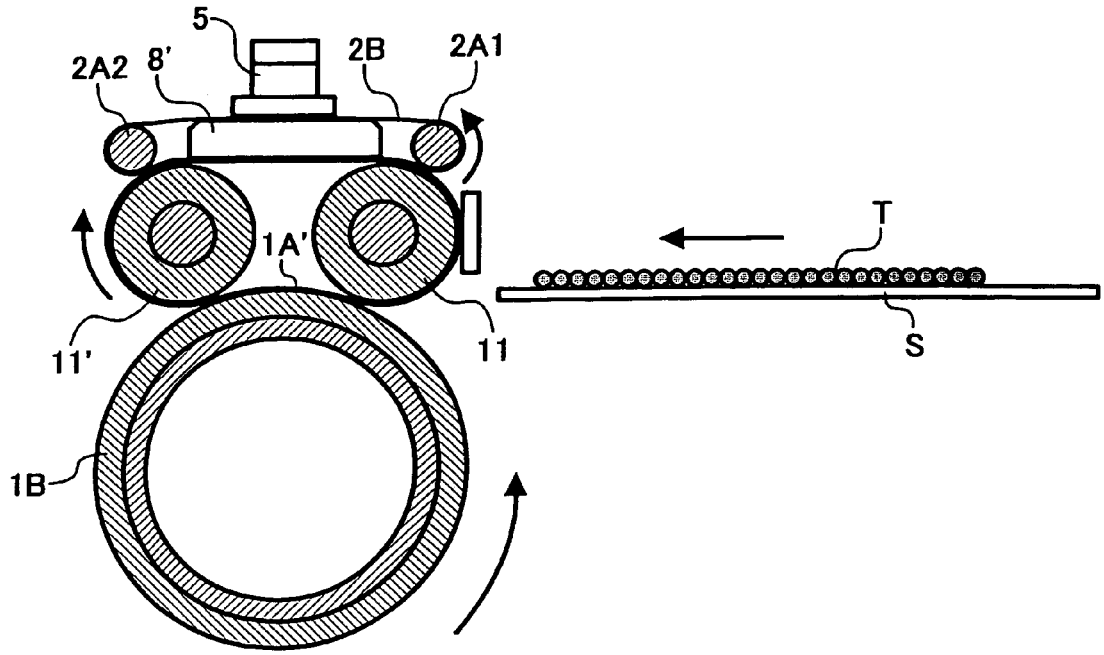
FIG. 14 is a view showing another modification of the fixing member and external heating member.

In the modification shown in FIG. 14, the planar heat generating body 8', FIG. 12, is applied to the belt 1A', FIG. 13, as a heat source.

Figure 15:
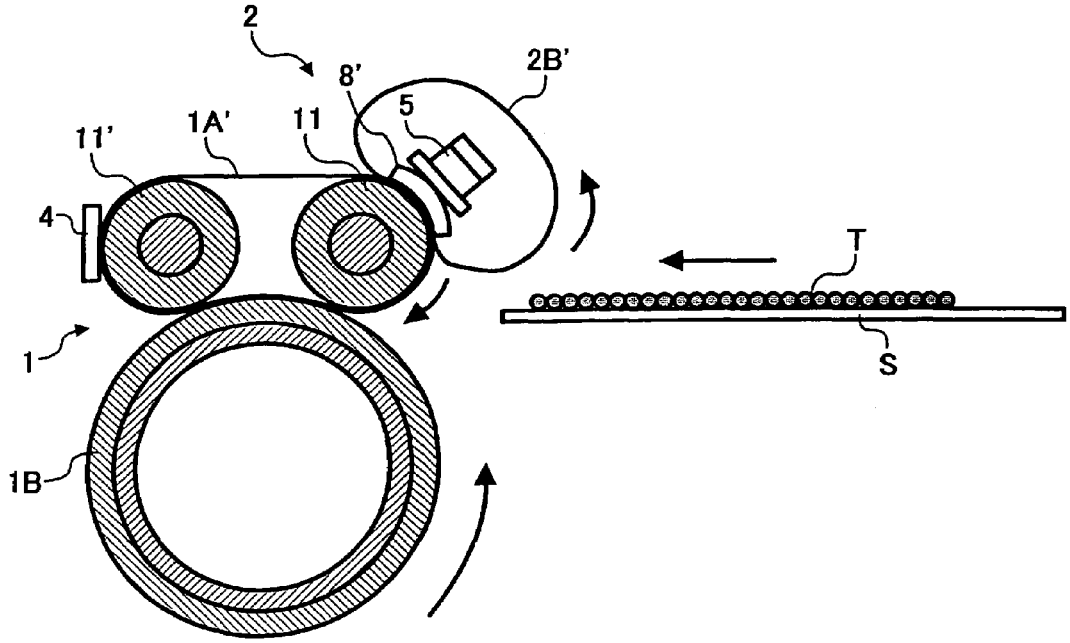
FIG. 15 is a view showing another modification of the fixing member and external heating member in relation to FIGS. 13 and 14.

In the modification shown in FIG. 15, the belt 2B', FIG. 11, is applied to the belt 1A', FIG. 13. The planar heat generating body 8', FIG. 12, is positioned in the loop of the belt 2B' and faces the belt 1A' with the intermediary of the belt 2B'.

Figure 16:
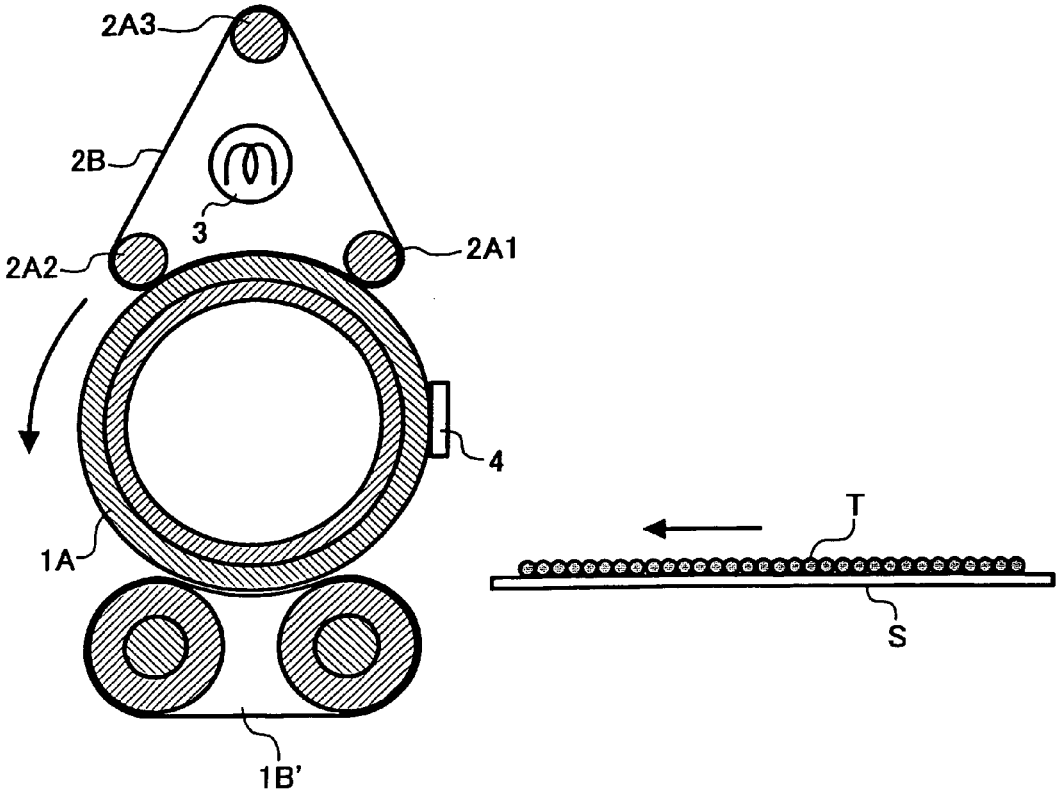
FIG. 16 is a view showing another modification of the fixing member and external heating member in relation to FIGS. 13 through 15.

In the modification shown in FIG. 16, the pressing member is implemented as a belt 1B' in place of the fixing member.

In the modifications of FIGS. 13 through 16 described above, the fixing belt 1A' or the pressing belt 1B' is made up of a base formed of, e.g., polyimide and a 1 mm thick heat insulating layer formed on the base and formed of liquid silicone rubber or foam silicone rubber.

In any one of the above modifications, the belt 2B or 2B' of the external heating member 2 heats the fixing belt 1A' in contact with the outer surface of the fixing belt 1A', so that is suffices to set the temperature of only the outer surface of the belt 1A'. Such external heating successfully reduces the warm-up time, compared to internal heating that heats a member having a large thermal capacity. Moreover, because the belt itself includes a heat insulating layer, heat losses ascribable to heat radiation or heat conduction do not occur, so that the belt can be maintained at the fixing temperature.

Figure 17:
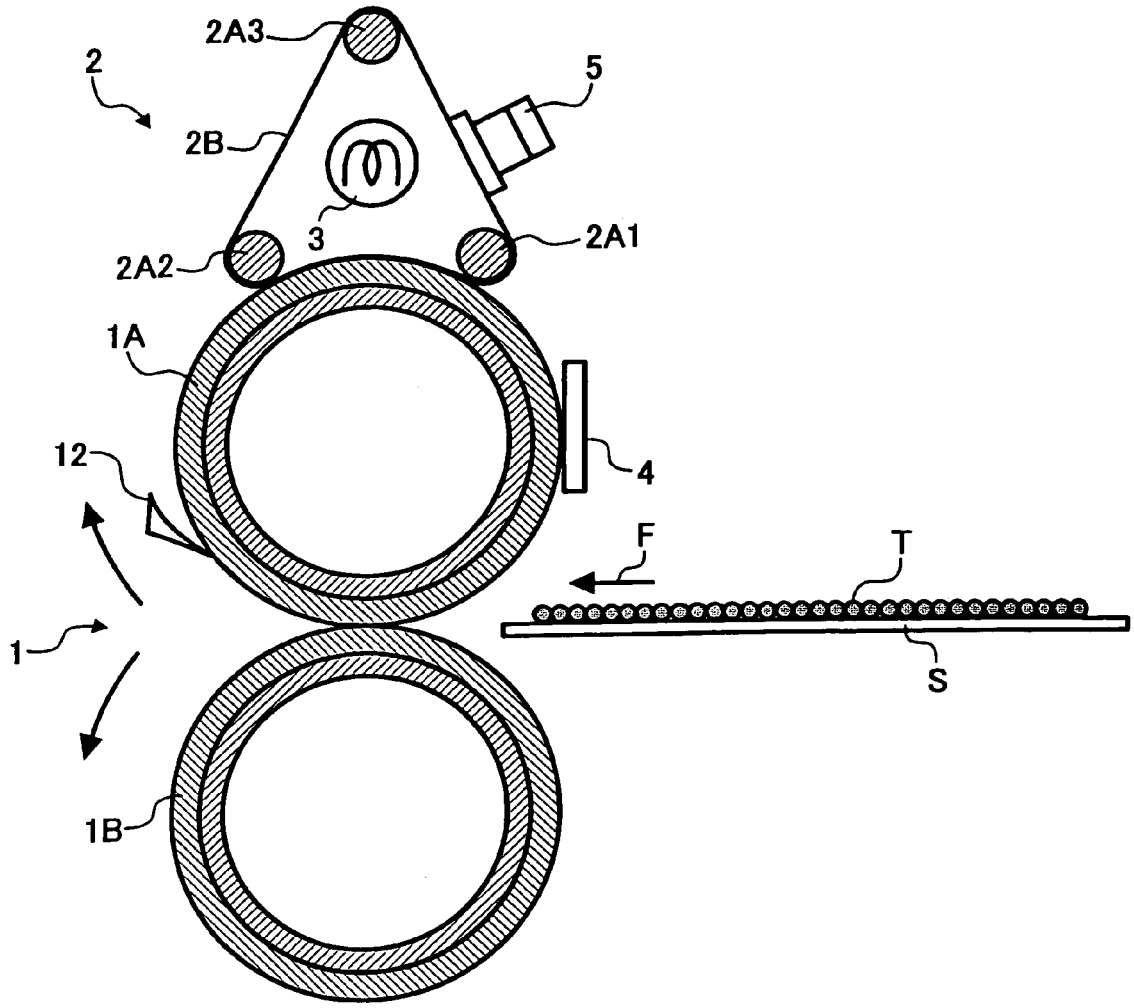
FIG. 17 is a view showing a seventh embodiment of the present invention.

Reference will be made to FIG. 17 for describing a seventh embodiment of the fixing device in accordance with the present invention. Briefly, this embodiment is characterized in that peeling means is located in the vicinity of the outlet of the nip or sheet conveying zone of the fixing member. Generally, a sheet is peeled off from a fixing member so as not to adhere to the fixing member due to toner offset and miss an outlet position. As shown in FIG. 17, the illustrative embodiment includes peeling means 12 adjoining the fixing roller 1A in the vicinity of the outlet of the nip between the fixing roller 1A and the press roller 1B. The peeling means is implemented as a thin, soft member that does not scratch the surface of the fixing roller 1A when contacting the roller 1A.

Assume that a sheet, wrapped around the fixing roller 1A, is conveyed to the peeling means 12 by the roller 1A. Then, the peeling means lifts the leading edge of the sheet away from the surface of the fixing roller 1A for thereby peeling off the sheet. Otherwise, the sheet would, e.g., catch fire on reaching the external heating member 2.

If desired, the temperature sensor 4, FIG. 8, may bifunction as the peeling means 12 so as to omit extra peeling means.

In addition to the peeling means, sensing means responsive to a sheet wrapped around the fixing roller 1A may be positioned between the outlet of the nip and the hating zone where the portion of the fixing roller 1A faces the belt 2B. In such a case, when the sensing means senses a sheet wrapped around the fixing roller 1A, the rotation of the roller 1A will be stopped while the peeling means will peel off the sheet. Such sensing means uses reflectance or similar optical factor. Further, when the sensing means senses the above sheet, the belt 2B may be released from the fixing roller 1A.

Figure 18:
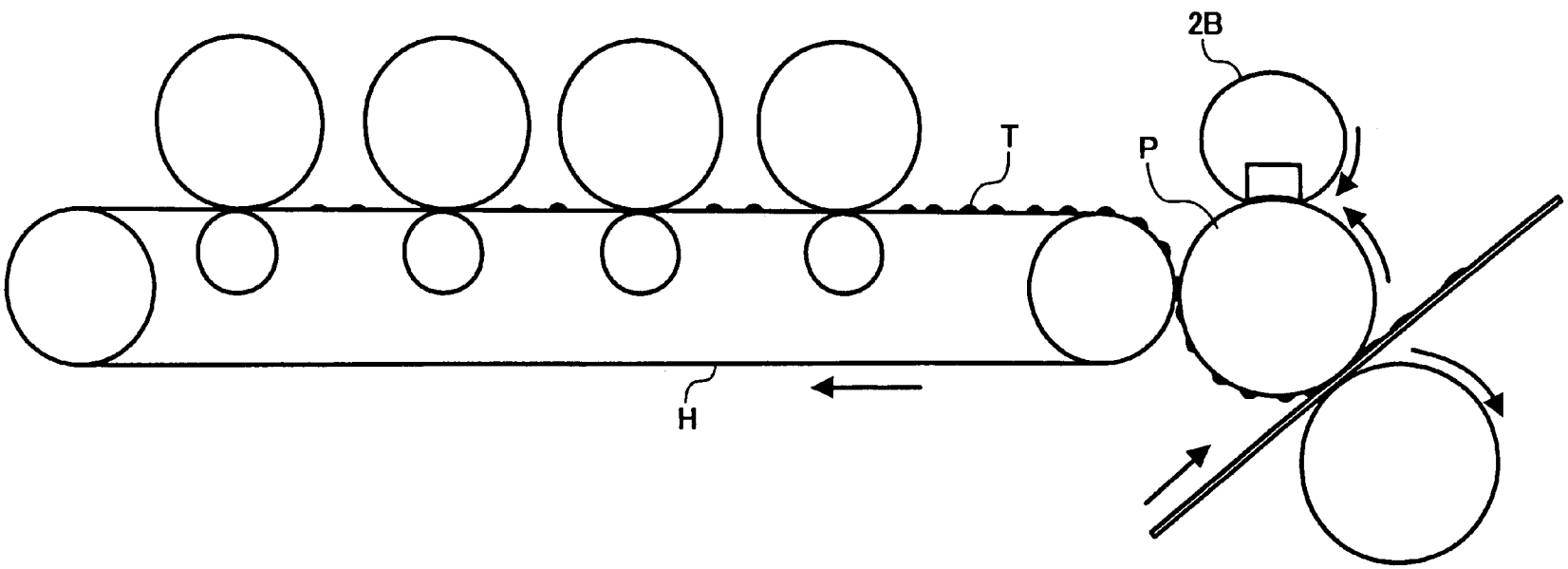
FIG. 18 is a view showing another image forming apparatus to which the present invention is applicable.

FIG. 18 shows another specific electrophotographic process that transfers toner T is transferred from an intermediate image transfer body H to a fixing member P instead of to a sheet. The present invention, using the belt 2B as an external heating device, is similarly applicable to the process shown in FIG. 18.

Various modifications will become possible for those skilled in the art after receiving the teachings of the present disclosure without departing from the scope thereof.

What is claimed is:

1. A fixing device for fixing a toner image formed on a recording medium, said fixing device comprising:

a rotatable member and a facing member forming a nip, which corresponds to a conveying zone, therebetween and configured to convey the recording medium via said nip for thereby fixing the, toner image on said recording medium; and a heating member configured to heat the surface of said rotatable member in contact with said surface, said heating member including an endless belt in contact with the surface of said rotatable member, wherein a portion of said rotatable member and a portion of said heating member contacting each other respectively have a convex shape and a concave shape complementary to said convex shape.

2. The device as claimed in claim 1, further comprising:

a sensor associated with said rotatable member for sensing a rotation speed of said rotatable member; and a controller configured to control an amount of heat to be generated by said heating member in accordance with an output of said sensor.

3. The device as claimed in claim 1, wherein said heating member moves in unison with said rotatable member in contact with said rotatable member.

4. The device as claimed in claim 3, further comprising:

a sensor associated with said rotatable member for sensing a rotation speed of said rotatable member; and a controller configured to control an amount of heat to be generated by said heating member in accordance with an output of said sensor.

5. The device as claimed in claim 1, wherein said heating member is movable in an opposite direction to said rotatable member.

6. The device as claimed in claim 5, wherein said heating member moves in unison with said rotatable member in contact with said rotatable member.

7. The device as claimed in claim 6, further comprising:

a sensor associated with said rotatable member for sensing a rotation speed of said rotatable member; and a controller configured to control an amount of heat to be generated by said heating member in accordance with an output of said sensor.

8. The device as claimed in claim 1, wherein the portion of said heating member contacting said rotatable member is deformable in the concave shape on contacting said rotatable member.

9. The device as claimed in claim 8, wherein said heating member is movable in an opposite direction to said rotatable member.

10. The device as claimed in claim 9, wherein said heating member moves in unison with said rotatable member in contact with said rotatable member.

11. The device as claimed in claim 10, further comprising:

a sensor associated with said rotatable member for sensing a rotation speed of said rotatable member; and a controller configured to control an amount of heat to be generated by said heating member in accordance with an output of said sensor.

12. In an image forming apparatus including a fixing device for fixing a toner image formed on a recording medium, said fixing device comprising:

a rotatable member and a facing member forming a nip, which corresponds to a conveying zone, therebetween and configured to convey the recording medium via said nip for thereby fixing the toner image on said recording medium; and a heating member configured to heat said surface of said rotatable member in contact with said surface, said heating member including an endless belt in contact with the surface of said rotatable member, wherein a portion of said rotatable member and a portion of said heating member contacting each other respectively have a convex shape and a concave shape complementary to said convex shape.

* * * * *